US006003725A

United States Patent [19]

Blankenau et al.

[11] Patent Number: 6,003,725

[45] Date of Patent: Dec. 21, 1999

[54] SINGLE VEND NEWSPAPER VENDING MACHINE

[76] Inventors: Edmund H. Blankenau, 606 S. 96th St., Omaha, Nebr. 68114; Gerald J. Blankenau, 2620 S. 70th St., Apt. 100, Lincoln, Nebr. 68506

[21] Appl. No.: 08/828,320

[22] Filed: Mar. 28, 1997

[51] Int. Cl.[6] ..... B65H 3/00

[52] U.S. Cl. ..... 221/195; 221/259

[58] Field of Search ..... 221/191, 195, 221/192, 213, 259, 7, 9, 15

[56] References Cited

U.S. PATENT DOCUMENTS 5,492,213 2/1996 Kim ..... 221/195

*Primary Examiner*—Kenneth W. Noland

*Attorney, Agent, or Firm*—Adam H. Jacobs

[57] ABSTRACT

A single vend newspaper vending machine having an elevator system mounted within the machine housing, the elevator system including a vertically movable inclined newspaper support plate and a ratchet system for ratcheting the vertically movably plate upwards and a newspaper thickness sensing device for sensing the thickness of the topmost paper. The elevator system is operative to elevate the next paper on the stack of papers to the same height as the former topmost paper as determined by the newspaper thickness sensing device so that paper may be engaged by one or more pusher bars which engage the topmost paper and move it to or towards a dispensing position. The topmost paper then disengages from the stack and may fall forward into the newspaper vending chute or may be pushed forwards by the pusher bars to a dispensing position.

11 Claims, 25 Drawing Sheets

SINGLE VEND NEWSPAPER VENDING MACHINE

CROSS-REFERENCE TO RELATED FOREIGN PATENT

This application claims priority based on a foreign patent, specifically on the German Gebrauchsmusters Patent Serial No. 296 05 773.8 dated Mar. 28, 1996 issued to Hans Wenner, a named inventor.

BACKGROUND OF THE INVENTION

1. Technical Field

The present invention relates to newspaper vending machines and, more particularly, to a single-vend, single-fold newspaper vending machine having an elevator system mounted within the machine housing, the elevator system including a vertically movable inclined newspaper support plate and a ratchet system for ratcheting the vertically movably plate upwards, the elevator system operative to elevate the next paper on the stack of papers to a particular position where that paper may be engaged by one or more pusher bars which engage the topmost paper moving it rearwardly, such that the topmost paper disengages from the stack and may fall forward into the newspaper vending chute.

2. Description of the Prior Art

Most newspaper vending machines on the market today are coin actuated and the insertion of a coin into the machine enables the prospective purchaser to open a door to gain access to the entire supply of newspapers within the machine. While the majority of customers will at that time only remove a single newspaper, there are some individuals who will remove multiple newspapers from the machine either for resale or distribution to others. Obviously, there is a need for a newspaper vending machine which will prevent the theft of newspapers from the machine.

Prior attempts have been made to overcome this problem by designing vending machines to dispense only a single copy of the newspaper in response to the insertion of coins in the machine. The scarcity of single copy newspaper vending machines is the best evidence of the failure of the prior art designs for single copy newspaper vending machines to address and solve the problems presented.

Various attempts have been made in the prior art to make single vend newspaper vending machines. For example, Moore, U.S. Pat. No. 4,139,120, discloses a newspaper vending machine which features an article holder which supports a newspaper stack. The reference also includes a pusher which frictionally or by piercing will engage each newspaper at the top of the stack and move it up and out of contact with the presser where upon the paper falls into a dispensing tray. The major disadvantage found in Moore, obviously, is that the intricate nature of the pulley system and movable nature of the pusher arrangement will almost certainly lead to numerous breakdowns and malfunctions while the invention is being used. Furthermore, there is no means by which the papers held within the machine can be seen to enable a potential purchaser to decide whether he or she should make that purchase.

Another example of a newspaper vending machine found in the prior art is shown in Godley, Sr., U.S. Pat. No. 4,312,461, which discloses a newspaper vending machine having a vertically moveable platform and a dispensing wedge. A drive shaft rotates to raise or lower the platform in response to rotation of an external crank thus vending the next newspaper on a stack. While Godley certainly presents a more simple and efficient system for vending newspapers than Moore, Godley includes several features which can be improved upon. For example, the dispensing mechanism for the newspaper involves the raising the stack of newspapers above a dispensing wedge thus allow the topmost newspaper to slide off of the top of the stack and thus be dispensed. However, some vended newspapers are of a narrow thickness and, therefore, as the platform is cranked upwards, the height added to the newspaper platform may cause two or more newspapers to fall from the top of the stack, thus resulting in the entire purpose for the invention being destroyed. Also, the crank handle as shown in Godley may be more prone to malfunctions due to the various connected elements within Godley. There is therefore a need for reliable and efficient single vend newspaper vending machine which will correctly vend even newspapers of narrow thickness.

Various other inventions have been proposed in the prior art which attempt to address and resolve the problems inherent in single vend newspaper vending machines. Included among these are such devices as Gunzler, U.S. Pat. No. 3,705,665, Wingate, U.S. Pat. Nos. 4,448,328, and 4,506,800, and Hennessy, U.S. Pat. No. 4,654,513. Each of these inventions, however, include inherent problems which do not fully address and solve the problem of producing an efficient and reliable single vend newspaper vending machine.

Therefore, an object of the present invention is to provide an improved single vend newspaper vending machine.

Another object of the present invention is to provide a single vend newspaper vending machine which includes an elevator system for raising a stack of newspapers to a predetermined height for engagement by a pushing mechanism which will lift the topmost paper from underneath a paper restraining tongue and allow the top most paper to fall forward into a dispensing chute.

Another object of the present invention is to provide a single vend newspaper vending machine which is capable of vending papers of varying thicknesses one at a time.

Finally, an object of the present invention is to provide a single vend newspaper vending machine which is safe, durable and efficient in use.

SUMMARY OF THE INVENTION

The present invention provides a single vend newspaper vending machine which includes a machine housing having outer walls. A newspaper elevator system is mounted in the machine housing, the newspaper elevator system including at least one slide track mounted in the machine housing and a fixed position height control member mounted in the machine housing. A vertically movable height control member is also mounted in the machine housing. A newspaper support trolley is movably mounted on the slide track and includes first and second releasable height control member engagement devices, the first engagement device operative to engage the fixed height control member, the second engagement device operative to engage the vertically movable height control member. The slide track, the fixed position height control member, the vertically movable height control member and the newspaper support trolley are all mounted within the machine housing such that when the newspaper support trolley is movably mounted on the slide track, the first releasable height control member engagement device engages the fixed position height control member and the second releasable height control member engagement device engages the vertically movable height control member. The first releasable height control member engagement device is operative to restrict downward movement of the newspaper support trolley when engaging the fixed position height control member, the second releasable height control member engagement device operative to permit downward movement of the vertically movable height control member, upwards movement of the vertically movable height control member causing the newspaper support trolley to be moved upwardly therewith.

The invention further includes a newspaper thickness sensing device movably mounted in the machine housing and is operative to determine the thickness of the topmost paper on the stack of papers held on the newspaper support trolley. A newspaper pusher device is mounted in the machine housing and is operative to engage a topmost paper on the newspaper stack supported on the newspaper support trolley and slide the topmost newspaper off of the newspaper stack, the newspaper pusher device moving the topmost newspaper towards and to a dispensing position in which at least part of the topmost newspaper is external of the machine housing whereby a customer can access the topmost newspaper and obtain possession thereof. Finally, a newspaper pusher and movable height control member actuation device such as an operating handle is operatively connected to the newspaper pusher device and the movable height control member such that engagement of the actuation device first actuates the newspaper pusher means to remove the topmost paper from the newspaper stack, the actuation device operative to secondly raise the movable height control member a distance determined by the thickness of the topmost paper as determined by the newspaper thickness sensing device, thereby raising the newspaper support trolley such that the penultimate newspaper replaces the vended topmost newspaper in substantially the same position that the topmost newspaper was in prior to being vended.

It is clear that the features of this invention combine to form an easily used and extremely durable and efficient single vend newspaper vending machine. It is thus seen that the present invention provides a substantial improvement over the prior art.

DESCRIPTION OF THE PREFERRED EMBODIMENT

Figure 3:
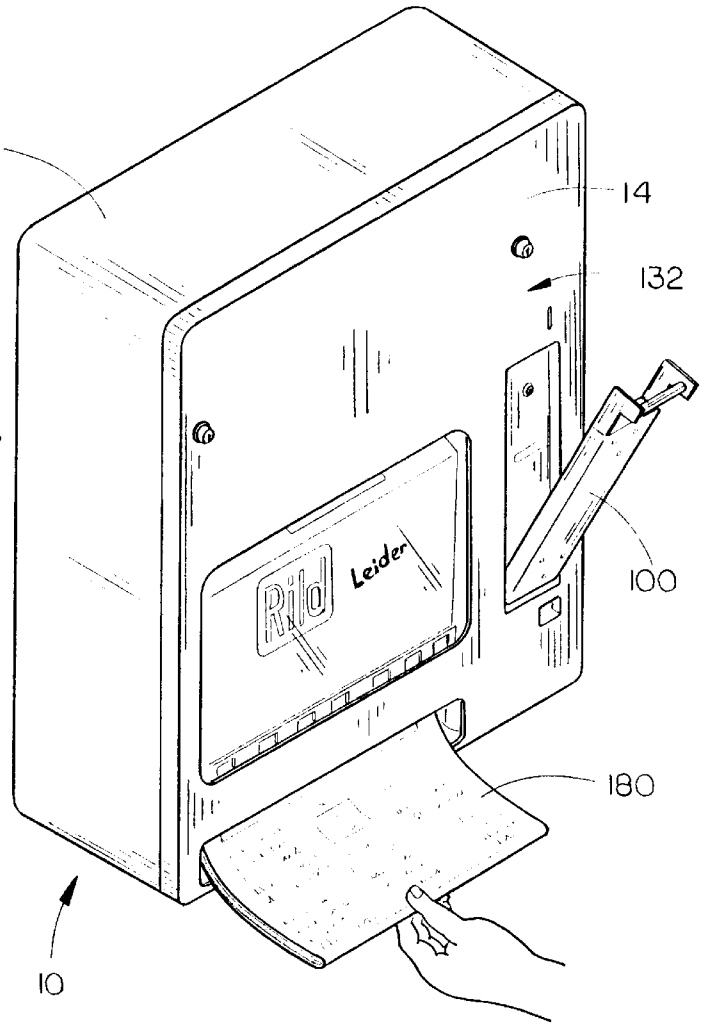
FIGS. 2 and 3 are perspective views of the present invention showing the newspaper vending machine vending a newspaper.
Figure 4:
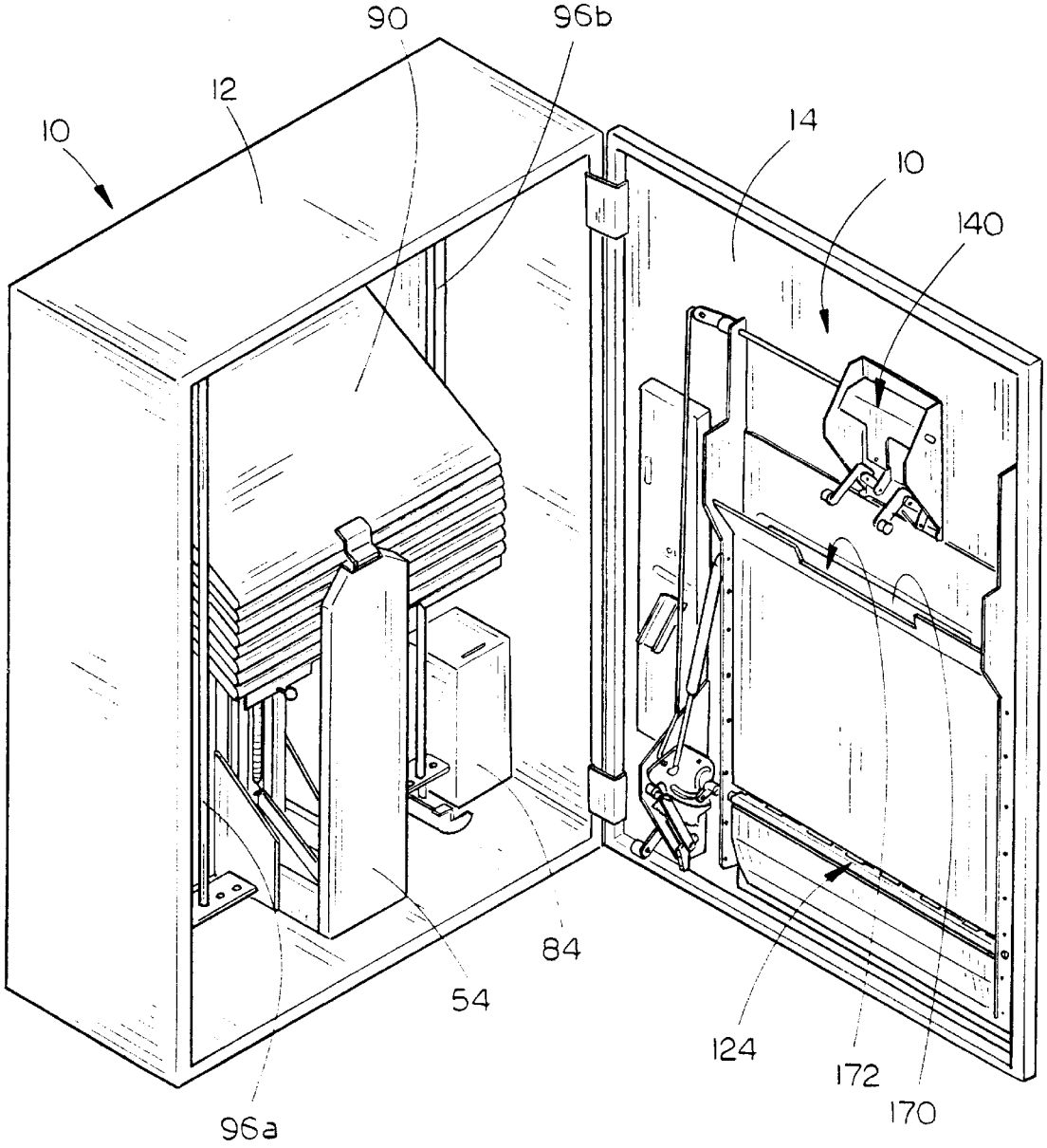
FIG. 4 is a perspective view of the newspaper vending machine showing the internal features thereof.
Figure 5:
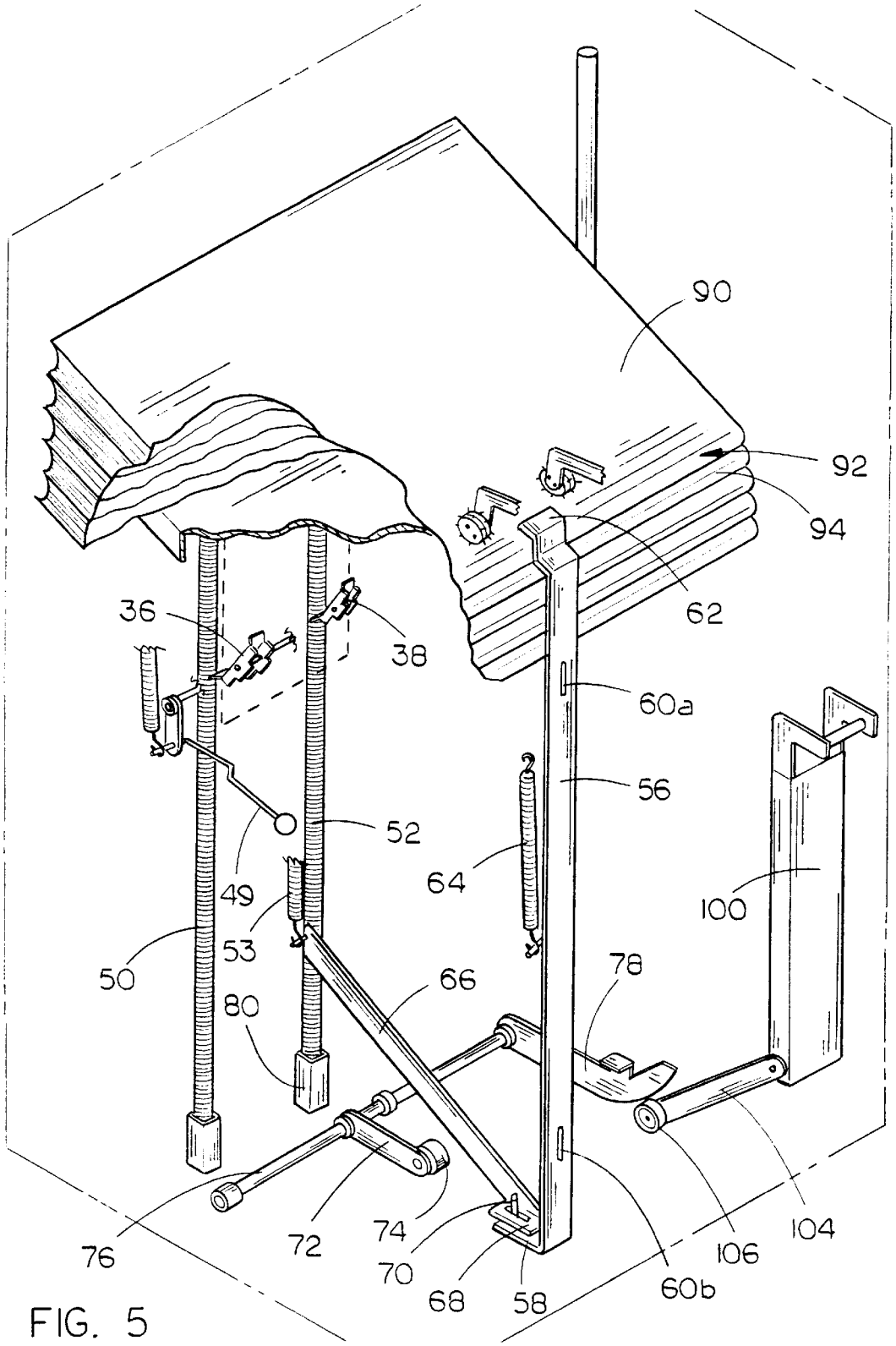
FIG. 5 is a detail view of the lifting mechanism of the elevator system.
Figure 6:
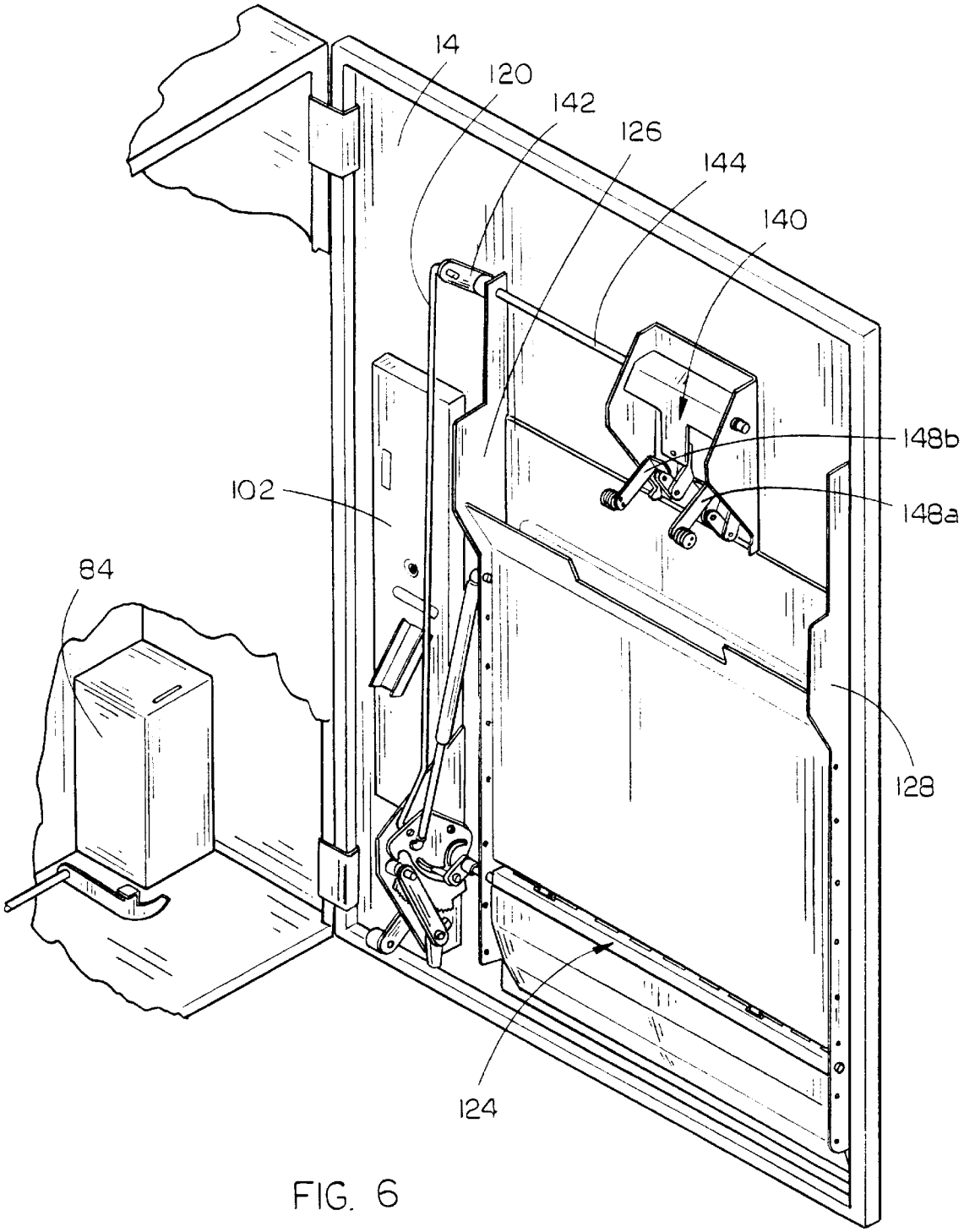
FIG. 6 is a partial detail perspective view of the front door elements of the newspaper vending machine.

The single vend newspaper vending machine 10 of the present invention is shown best in FIGS. 1–21 as including a generally rectangular box machine housing 12 including a hingeably mounted front door 14 shown best in FIG. 4. It is preferred that machine housing 12 be constructed of a medium-thickness sheet metal formed in a manner commonly associated with formation of sheet metal boxes. It is further preferred that machine housing 12 have a height of approximately 30 inches to 60 inches, a width between 20 inches and 50 inches, and depth between 10 inches and 15 inches. The machine housing 12 is adapted to be mounted on a wall or the like by any appropriate wall mount device.

The internal components of the single vend newspaper vending machine 10 may be divided into two general categories, those features mounted within the machine housing 12 and those features mounted on the front door 14. Of course, it is to be understood that for many of these features described below the mounting on the door 14 or in the machine housing 12 is not critical provided that the elements are mounted in such a way as to insure proper functioning and interfunctioning of the various elements. The following description shall begin with the features mounted within the machine housing 12.

Figure 7:
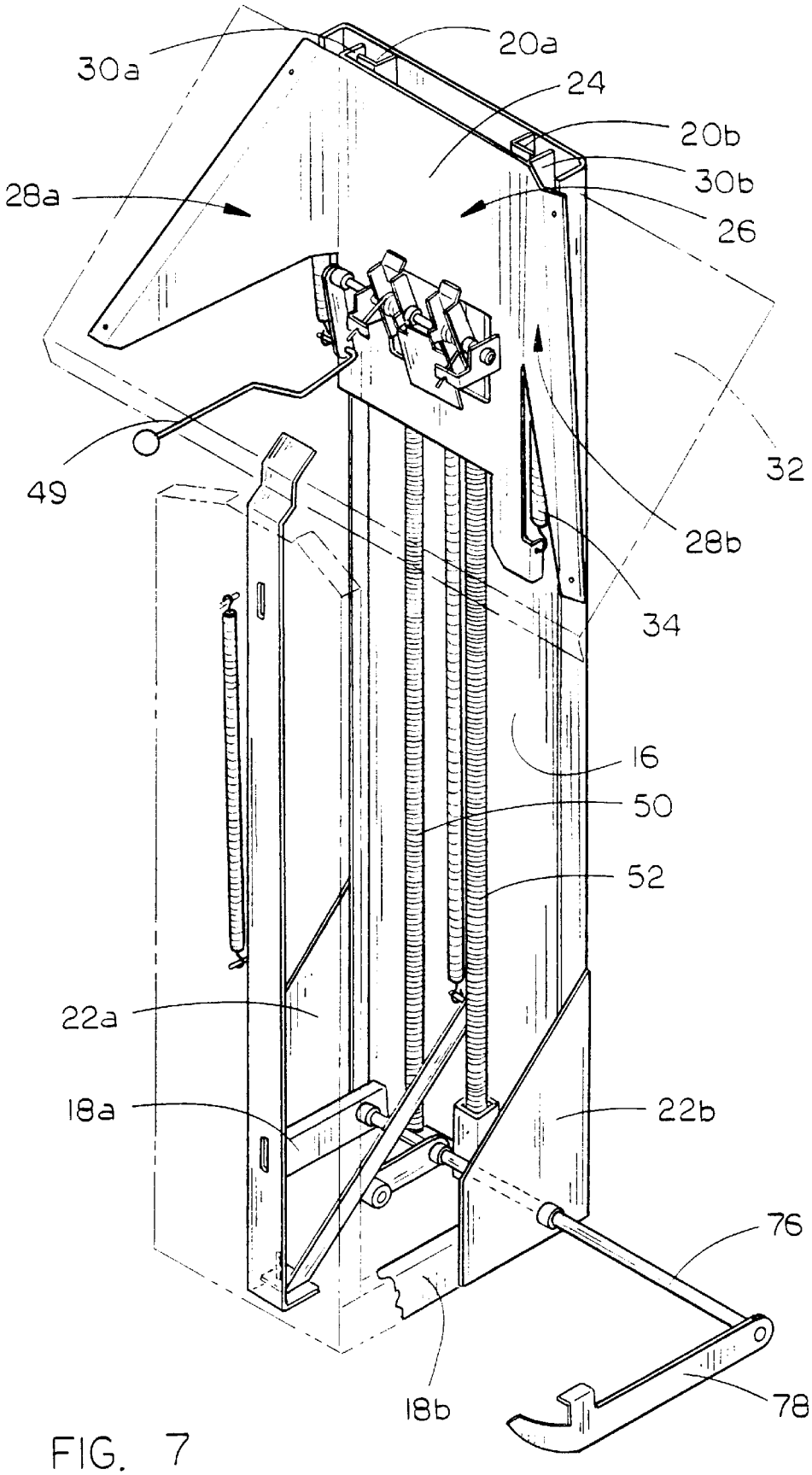
FIG. 7 is a partial detail perspective view of the elevator system of the present invention.

The machine housing features of the present invention are best shown in FIGS. 4, 5, and 7–9 and include a generally vertical slide track 16 which extends upwards and is connected to base legs 18*a* and 18*b*. It is preferred that slide track 16 be formed of sheet metal and include a pair of vertical channels 20*a* and 20*b*, best shown in FIG. 7. To increase the connection strength between slide track 16 and base leg 18*a* and 18*b*, a pair of reinforcement plates 22*a* and 22*b*, are preferably connected to slide track 16 and base legs 18*a* and 18*b* as shown in FIG. 7.

Vertically movably mounted on slide track 16 is a newspaper support trolley 24 which, in the preferred embodiment, includes a generally rectangular rear plate 26 and left and right forwardly extending triangular wings 28*a* and 28*b* which extend forward from and are connected to opposite sides of rear plate 26. Mounted on the rear plate 26 adjacent to slide track 16 are a pair of track follower devices 30*a* and 30*b* which are preferably channel-engaging wheels designed to fit within and be in contact with the channels 20*a* and 20*b* on slide track 16. In this manner, newspaper support trolley 24 may travel in a generally vertical plane as directed by channels 20*a* and 20*b* and track follower devices 30*a* and 30*b*.

Mounted to the upper edges of forwardly extending wings 28*a* and 28*b* is a newspaper support plate 32, shown by the dotted lines in FIG. 7. In the preferred embodiment, newspaper support plate 32 would be constructed of heavy gauge sheet metal and would be inclined forwardly at an angle between 30 degrees and 60 degrees although it is preferred that the actual angle of the newspaper support plate 32 be approximately 40 degrees. The dimensions of the newspaper support plate 32 should be such that when a newspaper is placed on the newspaper support plate 32 the newspaper overhangs the left and right side edges and front edge approximately one-half to one and one-half inches on each side. Also, for biasing the newspaper support trolley 24 upwards to partially counteract the weight of the stack of newspapers supported thereon, a spring 34 is connected to an extension of rear plate 26 and extends upwards to connect to the slide track 16 at a point generally adjacent the top of slide track 16. The spring 34 assists the ratchet mechanism which will be described in the following paragraph.

Figure 9:
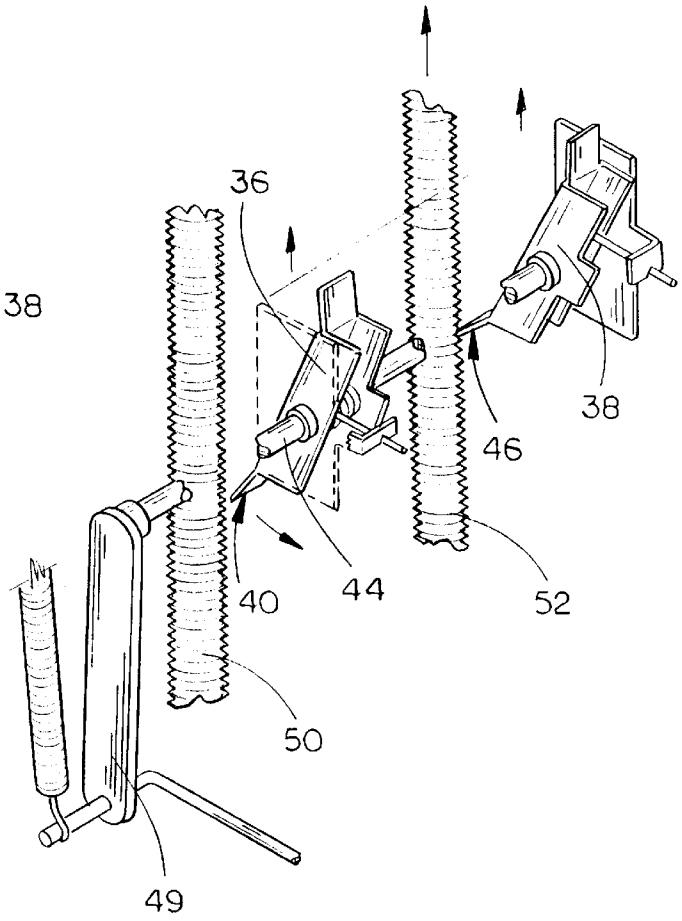
FIGS. 8 and 9 are partial detail perspective views of the rack-engaging pawls and ridged racks of the elevator system of the present invention.
Figure 8:
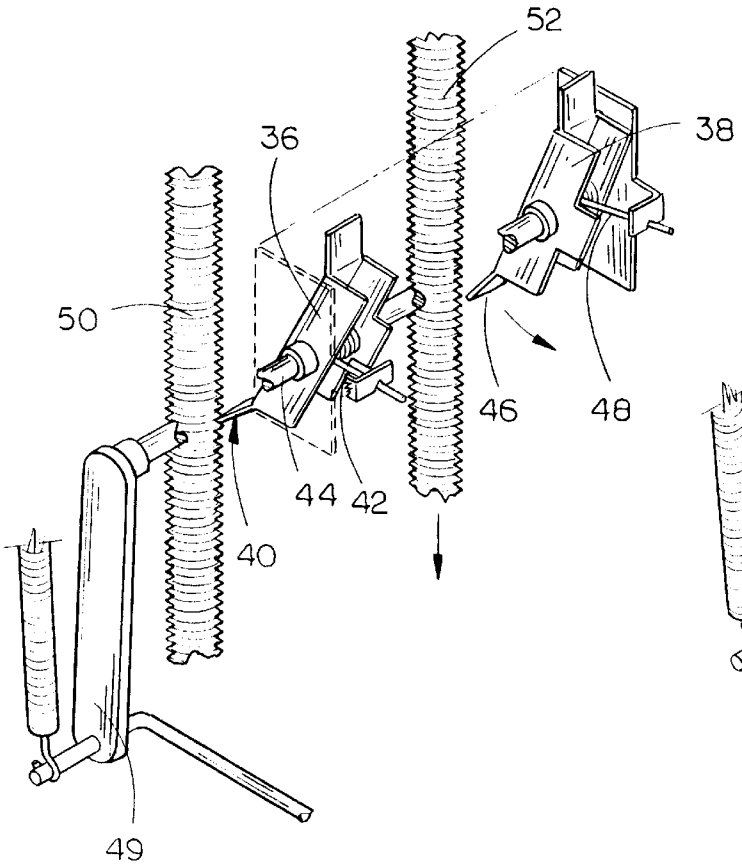

Mounted on rear plate 26 of newspaper support 24 are first and second rack-engaging pawls 36 and 38, each of which are pivotally mounted on rear plate 26 as shown best in FIG. 7, 8 and 9. The first rack-engaging pawl 36 is designed to engage a vertically mounted fixed ridged rack 50 which in the preferred embodiment is a cylindrical threaded rod which extends from the base of slide track 16 to the top of slide track 16 and is aligned with the line of motion of the newspaper support trolley 24 up and down slide track 16. The fixed ridged rack 50 is preferably welded to the slide track 16 at various points along the rack 50 to prevent movement of the rack 50. Second rack-engaging pawl 38, on the other hand, is designed to engage a vertically movable ridged rack 52, the vertically movable ridged rack 52 being free to move along a vertical line parallel with the line of movement of the newspaper support trolley 24 such that second rack-engaging pawl 38 may always engage vertically movable ridged rack 52. Of course, the racks 50 and 52 may be substituted for by any appropriate height control member, and the pawls 36 and 38 may be substituted for by any appropriate height control member engagement device. As shown best in FIGS. 8 and 9, the extended tab 40 of first rack-engaging pawl 36 engages the threaded ridges of fixed ridged rack 50 in such a manner as to prevent downward movement of newspaper support trolley 24 while first rack-engaging pawl 36 is engaged with fixed ridged rack 50. To keep extended tab 40 of first rack-engaging pawl 36 engaged with fixed ridged rack 50, a coiled wire spring 42 is mounted on the pivot bar 44 of the rack-engaging pawls 36 and 38, the wire spring 42 biasing the extended tab 40 of first rack-engaging pawl 36 forwards to engage fixed ridged rack 50. Similarly, second rack-engaging pawl 38 also includes an extended tab 46 which engages vertically movable ridged rack 52 due to the tension provided by coiled wire spring 48 on second rack-engaging pawl 38. Because the coiled wire springs 42 and 48 will always bias first and second rack-engaging pawls 36 and 38 to engage fixed ridged rack 50 and vertical movable rack 52, it is thus necessary to provide a means for disengaging the first and second rack-engaging pawls 36 and 38 from the racks 50 and 52 to allow the newspaper support trolley 24 to move downwards for reloading of the newspapers in the newspaper vending machine 10. Therefore, a pawl release mechanism 49 is provided which pivots the first and second rack-engaging pawls 36 and 38 away from fixed ridged rack 50 and vertically movable ridged rack 52 by pivoting bar 44. While the pawl release mechanism 49 is shown in FIG. 7 as including an extended bar and knob 4 rotating pivot bar 44, it is to be understood that any appropriate release mechanism may be employed so long as the first and second rack-engaging pawls 36 and 38 may be pivoted to disengage from fixed ridged rack 50 and vertically movable ridge rack 52. The reloading of newspapers would be performed by releasing the pawls 36 and 38 and moving the newspaper support trolley 24 downwards along slide track 16. The papers are then placed on the newspaper support plate 32 when the pawl release mechanism 49 is reengaged. The single vend newspaper machine 10 is then "primed" as will be described below.

Mounted on and extending upwards from the forward ends of base legs 18*a* and 18*b* is a forward bulkhead 54 which, in the preferred embodiment, would be a generally vertical sheet metal plate which includes rearwardly extending tabs to provide additional structural strength to the bulkhead 54. Vertically movably mounted on forward bulkhead 54 on the rearward side thereof is a newspaper thickness sensing bar 56 which is a generally flat steel bar including a generally horizontal foot section 58, two or more vertical connection slots 60*a* and 60*b* and an angled paper-engaging tab 62 which preferably extends parallel with the newspaper support plate 32 and extends over and above newspaper support plate 32 such that the top most paper on the stack of newspapers may be engaged by the underside of paper-engaging tab 62. Newspaper thickness sensing bar 56 is preferably biased upwards slightly by a spring 64, as shown in FIG. 7 to at least partially offset the weight of newspaper thickness sensing bar 56 and to allow for easier vertical movement of the newspaper thickness sensing bar 56.

As shown best in FIG. 7, vertically movable ridged rack 52 is connected to newspaper thickness sensing bar 56 by a diagonal strut 66 which is welded at the upper end thereof to vertically movable ridged rack 52 and includes at the lower end thereof a generally horizontal foot 68 which includes a hole through which a pin 70 mounted on and extending upwards from foot section 58 of sensing bar 56 may extend to seat the foot 68 of diagonal strut 66 on horizontal foot 58 of newspaper thickness sensing bar 56. In this manner, vertical movement of newspaper thickness sensing bar 56 is translated directly to vertical movement of vertically movable ridged rack 52 such that when newspaper thickness sensing bar 56 falls a particular distance, vertically movable ridged rack 52 falls exactly the same distance. The coordinated functionality of each of the above-described features will be set forth below in connection with the operation of the door-mounted internal features of the single-vend newspaper vending machine 10.

For lifting the vertically movable ridged rack 52, a lift bar 72 and end-mounted roller 74 are fixedly mounted on a pivoting lift rod 76 which is rotatably mounted on one end thereof to one of the base legs 18*a* and extends generally horizontally through base leg 18*b* and therethrough to be attached to a lever arm 78 which extends perpendicular to lift rod 76 and forwards therefrom. In this manner, lifting of lever 78 results in rotation of lift rod 76, which thus rotates lift bar 72 and causes roller 74 to contact the underside of diagonal strut 66. As lever 78 is further rotated, the roller 74 engaging diagonal strut 66 pushes diagonal strut upwards thus forcing vertical moveable ridged rack 52 upwards likewise. Of course, the extent to which roller 74 may raise diagonal strut 66 is limited by the length of lift bar 72 and, therefore, the length of lift bar 72 is critical to the invention as it is that length which determines the extent to which the vertically movable ridged rack 52 will be raised. In the preferred embodiment, the length of lift bar 72 would be such that the topmost paper on the stack would be moved to the proper dispensing position each and every time. An adjustment device such as a screw or the like may be included for fine adjustment of the position of the topmost newspaper the operation of which would be understood by those skilled in the art.

To further assist in the lifting of the vertically movable ridged rack 52, a spring 53 preferably extends upwards from adjacent the base of vertically movable ridged rack 52 to a point above on slide track 16 as shown in FIG. 7 to bias vertically movable ridged rack 52 upwards to at least partially offset the weight of vertically movable ridged rack 52 and diagonal strut 66. Finally, to ensure that vertically movable ridged rack 52 always remains in alignment with second rack-engaging pawl 38, a rack mount tube 80 is mounted on slide track 15 adjacent to the base thereof, the rack mount tube 80 having an internal diameter slightly greater than the external diameter of vertically movable ridged rack 52 such that rack 52 may be sizably housed within rack mount tube 80. Likewise, adjacent the top of ridged rack 52 is a rack guide loop (not shown) which movably secures vertically movable ridged rack 52 in a vertically aligned position such that second rack-engaging pawl 38 may always engage vertically movable ridged rack 52.

Figure 1:
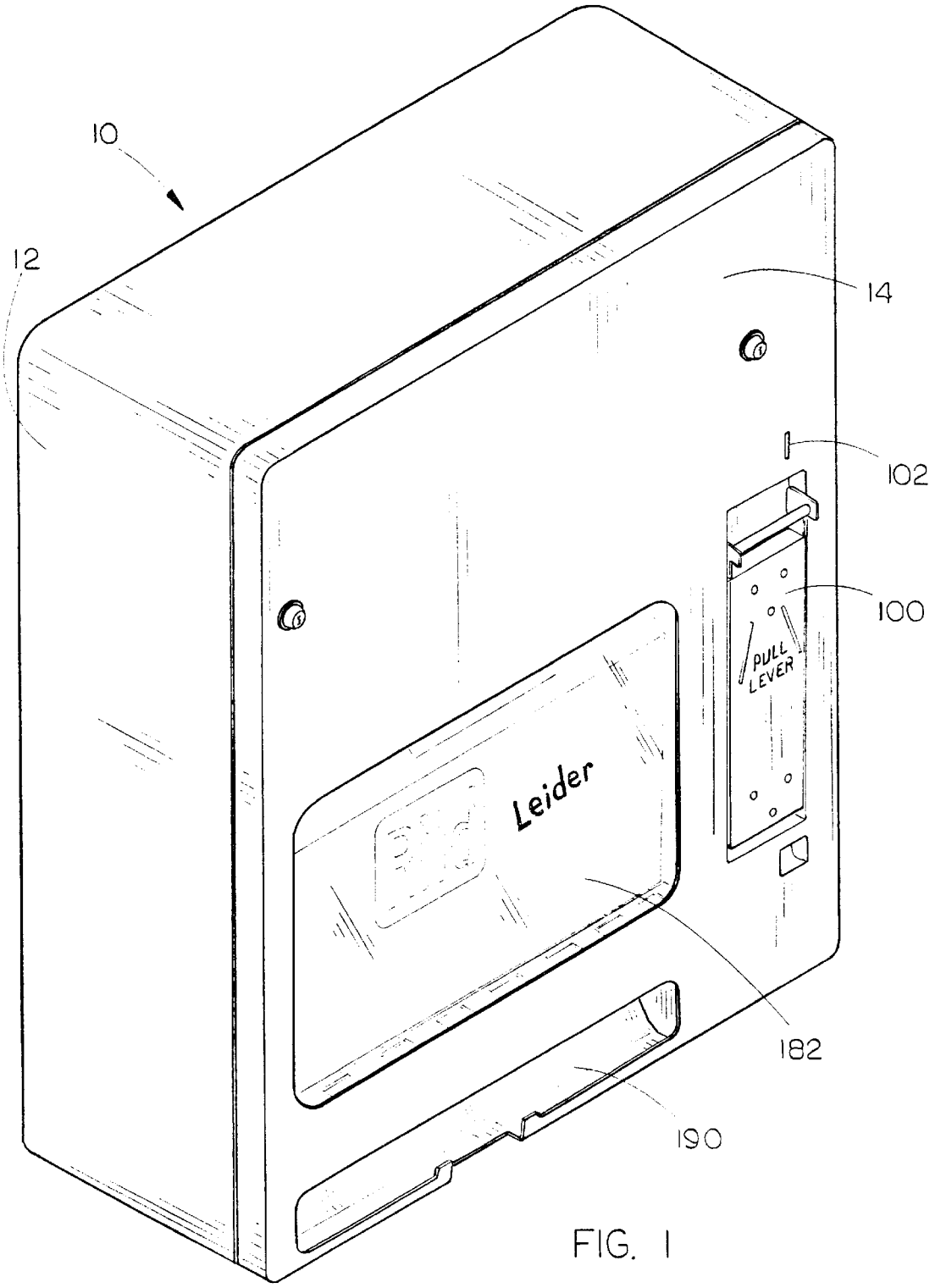
FIG. 1 is a perspective view of the single vend newspaper vending machine of the present invention.
Figure 2:
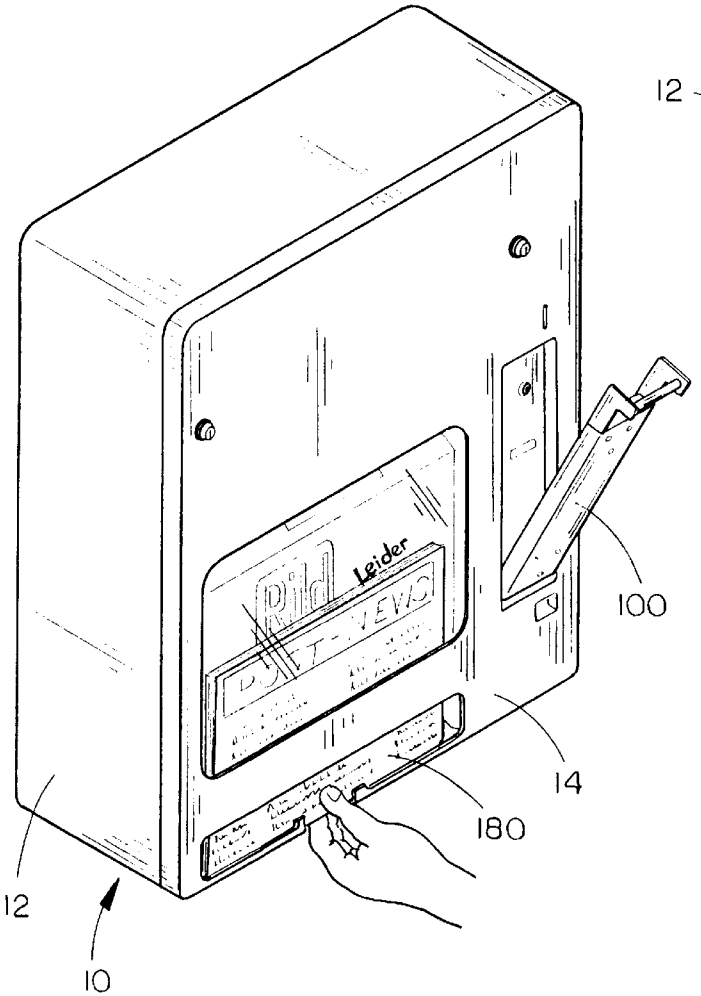

The door elements of the single vend newspaper vending machine 10 are best shown in FIGS. 2–6 and 17–21 as including an operating handle 100 which is hingeably mounted on the front of front door 14 as shown in FIGS. 1–3. Operating handle 100 is part of the standard coin intake mechanism 102 which accepts coins into the single vend newspaper vending machine 10 and deposits them in a coin deposit box 84 shown best in FIGS. 4 and 6. Once the appropriate coins are fed into the coin intake mechanism 102 the operating handle 100 may then be pulled forward by a person desiring the dispensing of a newspaper from the single vend newspaper vending machine 10. The operating handle 100 is operatively connected to several different actuating mechanisms, including a lever-engaging bar 104 having a roller 106 mounted on the end thereof, shown best in FIGS. 14–16 and a metal actuating plate 108, shown best in FIGS. 17–19. The metal actuating plate 108 is preferably adjacent operating handle 100 on the interior of the front door 14, the plate 108 connected to operating handle 100 such that rotation of operating handle 100 about its pivot point results in rotation of metal actuating plate 108 about pivot point 110.

Figure 17:
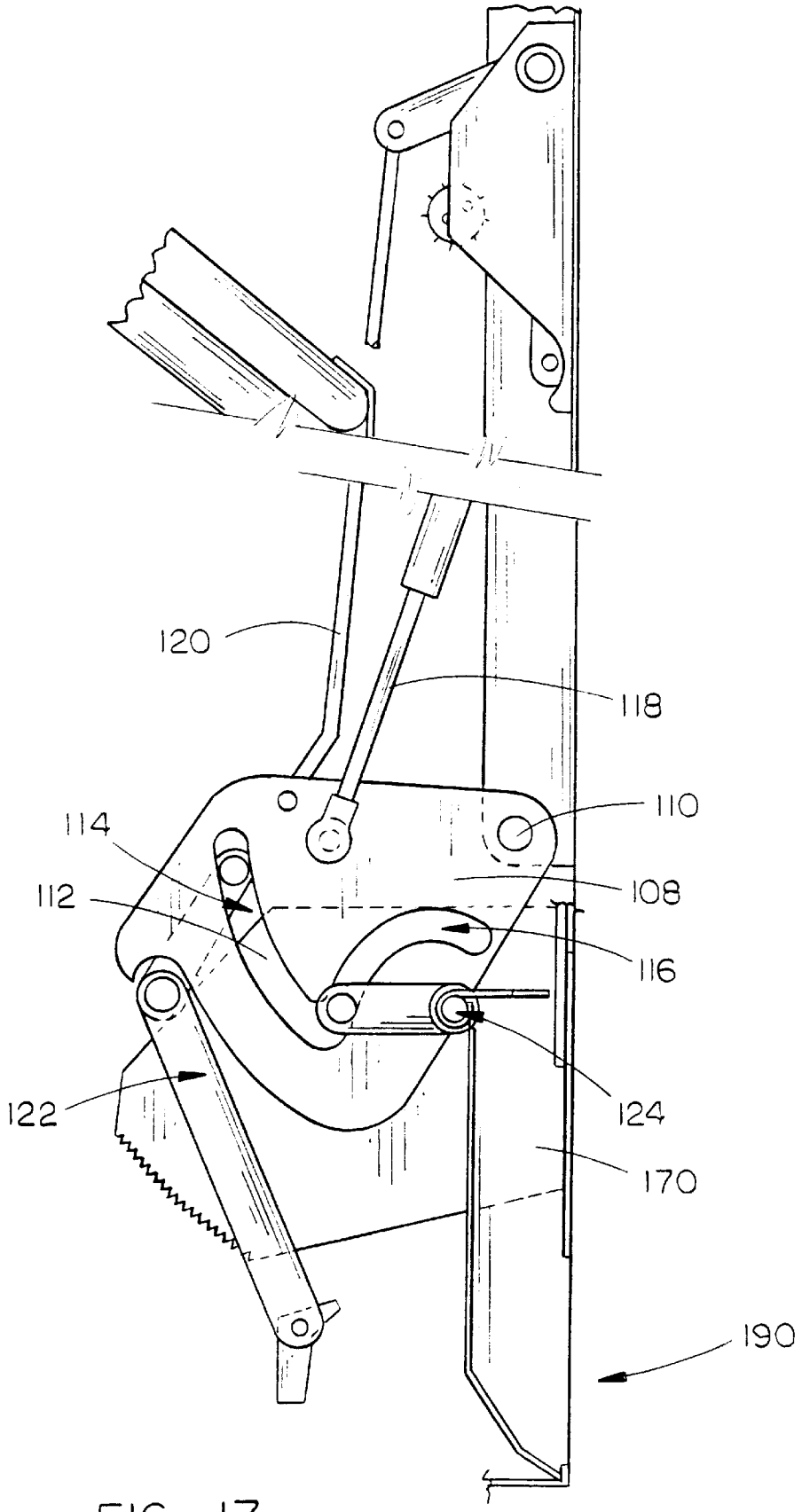
FIGS. 17–19 are partial detail side elevational views of the metal actuating plate and functioning thereof.
Figure 19:
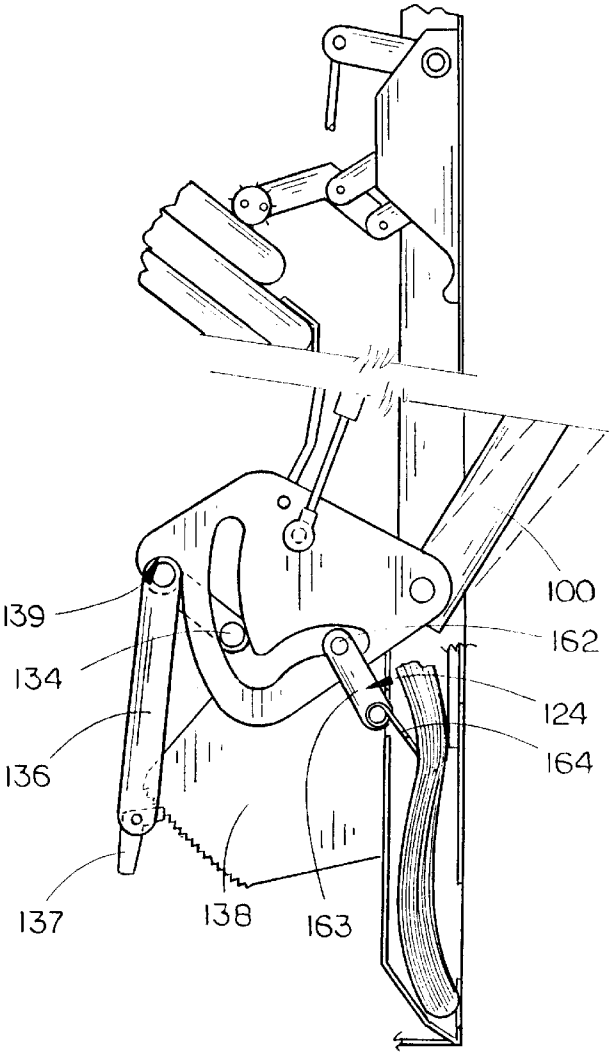
Figure 18:
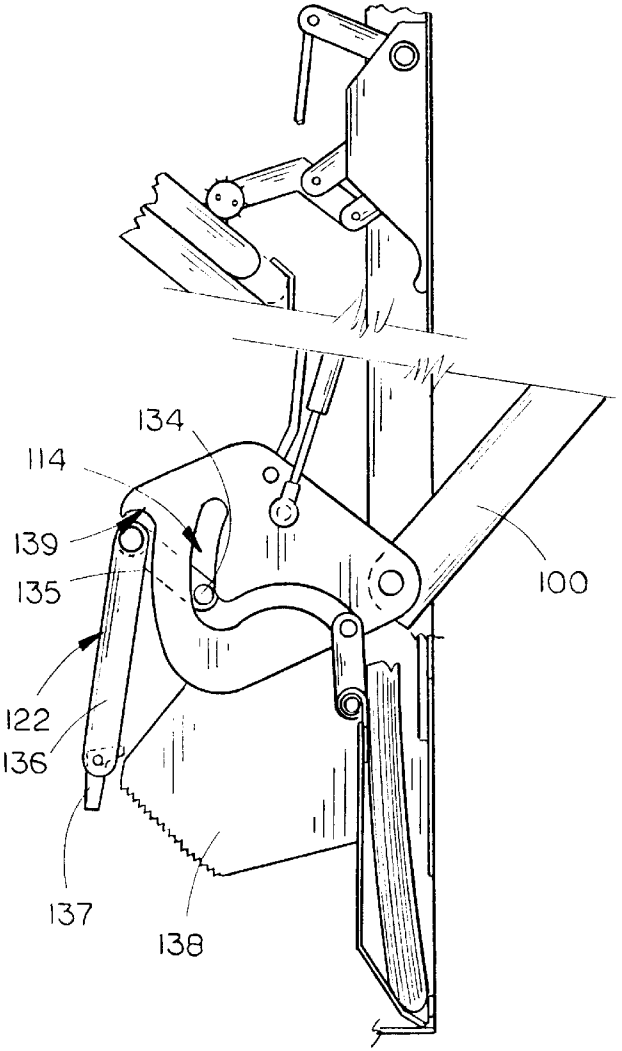
Figure 21:
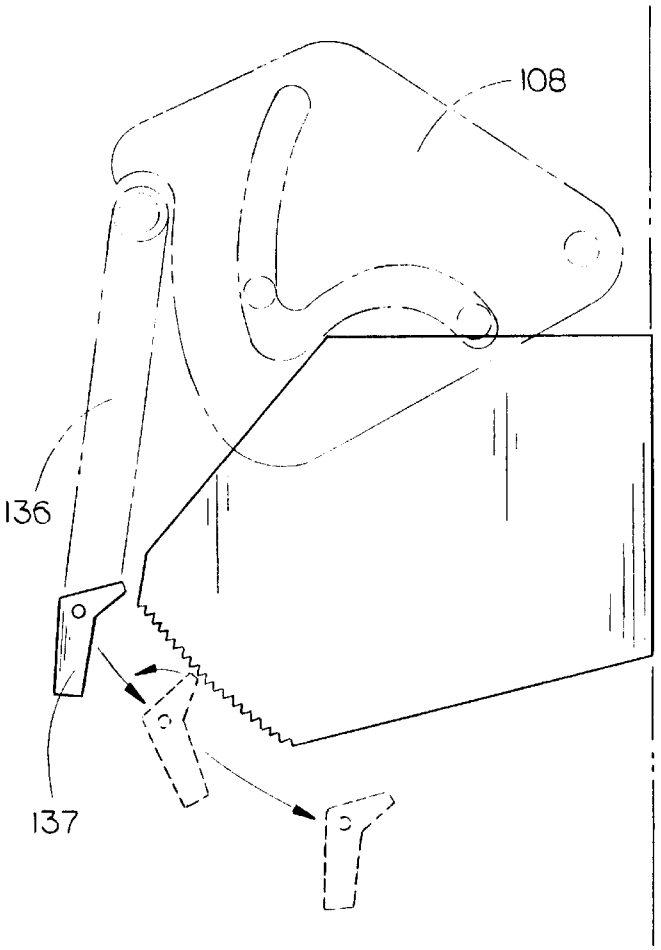
FIGS. 20 and 21 are partial detail side elevational views of the present invention showing the handle return prevention device in operation.
Figure 20:
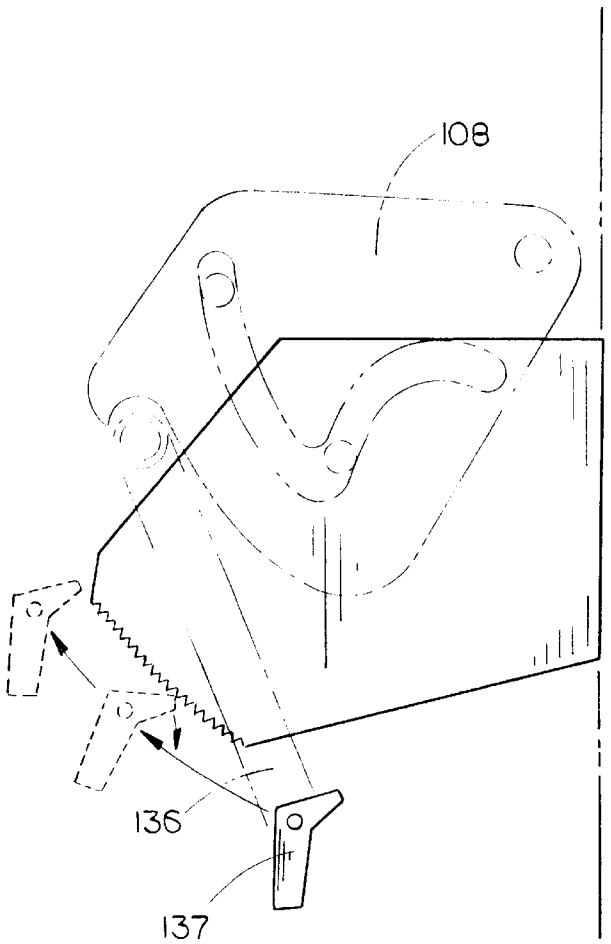

As shown best in FIG. 17, metal actuating plate 108 includes an arcuate slot 112 having left and right legs 114 and 116. Connected to the top of metal actuating plate 108 is a hydraulic cylinder which extends between metal actuating plate 108 and the interior of front door 14 as shown in FIG. 4, the hydraulic cylinder biasing the handle 100 back to its rest position adjacent the door 14. A pusher mechanism actuation bar 120 is connected to plate 108 adjacent hydraulic cylinder 118, the actuation bar 120 extending upwards from metal actuating plate 108 to connect to the newspaper pusher mechanism 140, which will be described below. Finally, a handle return prevention device 122 is mounted on the inner side of metal actuating plate 108, as shown in FIGS. 17–19, the handle return prevention device 122 operative to prevent operating handle 100 from returning to its rest position adjacent to coin intake mechanism 102 unless operating handle 100 has been pulled downwards the full extent permitted by the operating mechanism. Finally, mounted on paper release chute 170 is a gate mechanism 124 which prevents release of a paper to the paper release chute 170 until the operating handle 100 is pulled.

Figure 11:
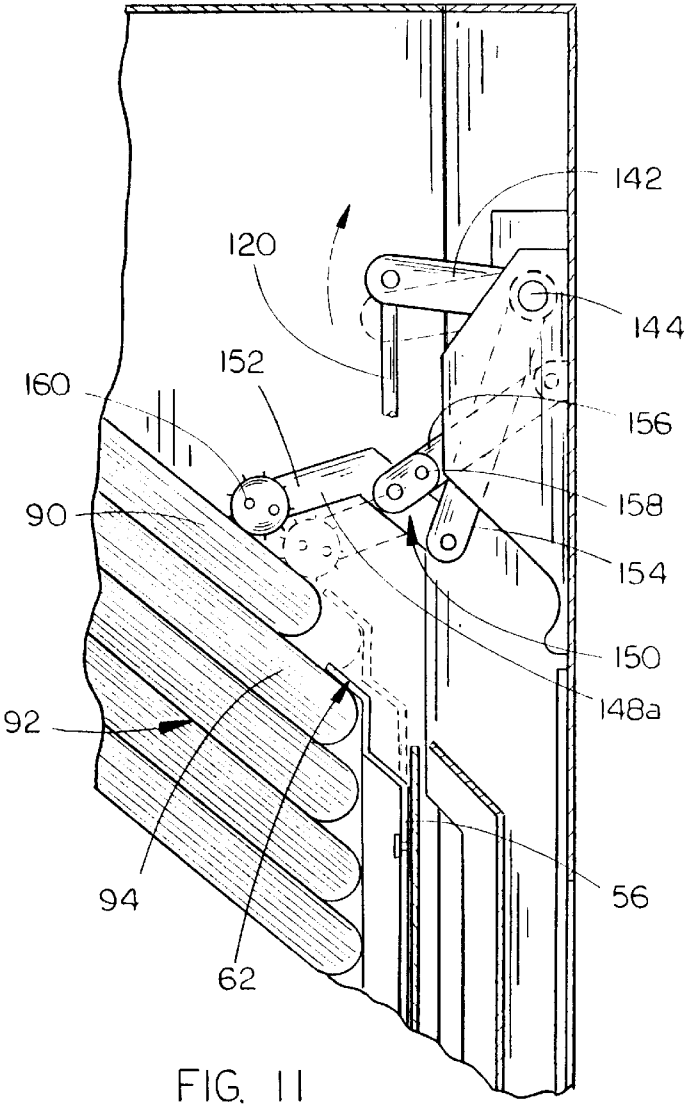
FIGS. 10, 11, and 12 are partial detail side elevational views showing the pusher mechanism of the present invention in operation.
Figure 10:
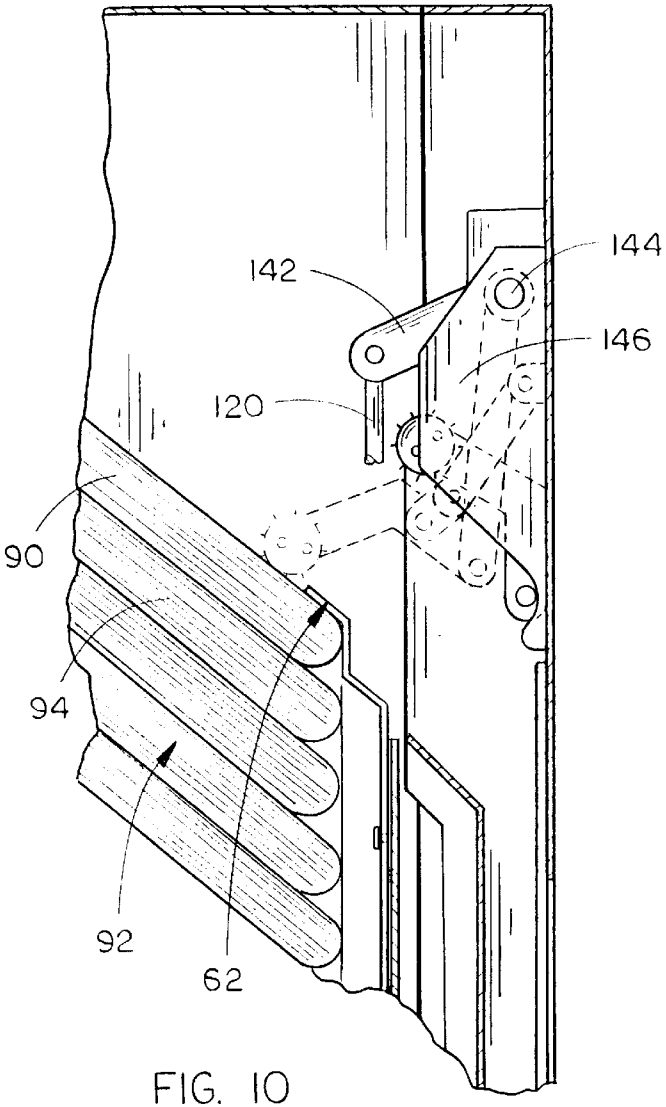
Figure 13:
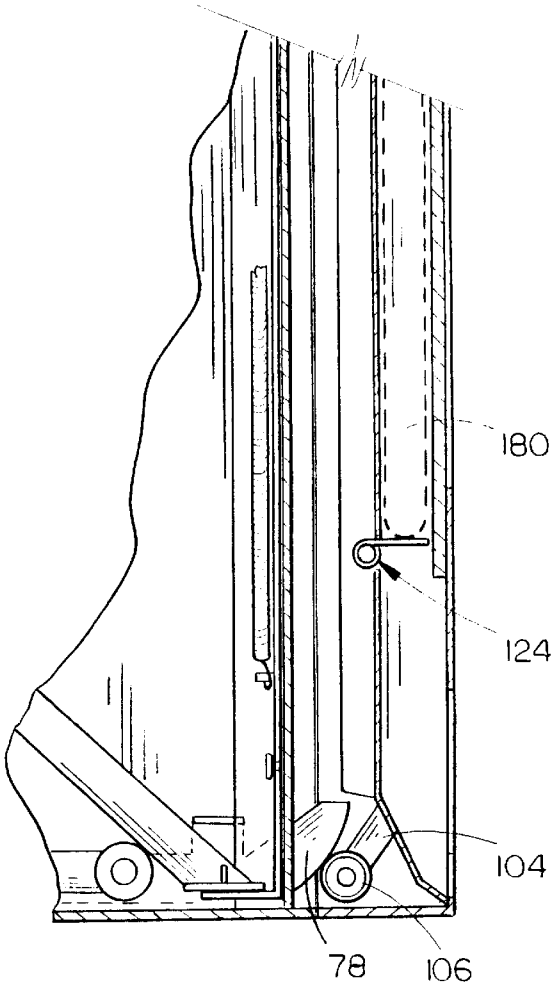
FIG. 13 is a partial detail side elevational view of the base of the dispensing chute showing the gate mechanism therein.
Figure 12:
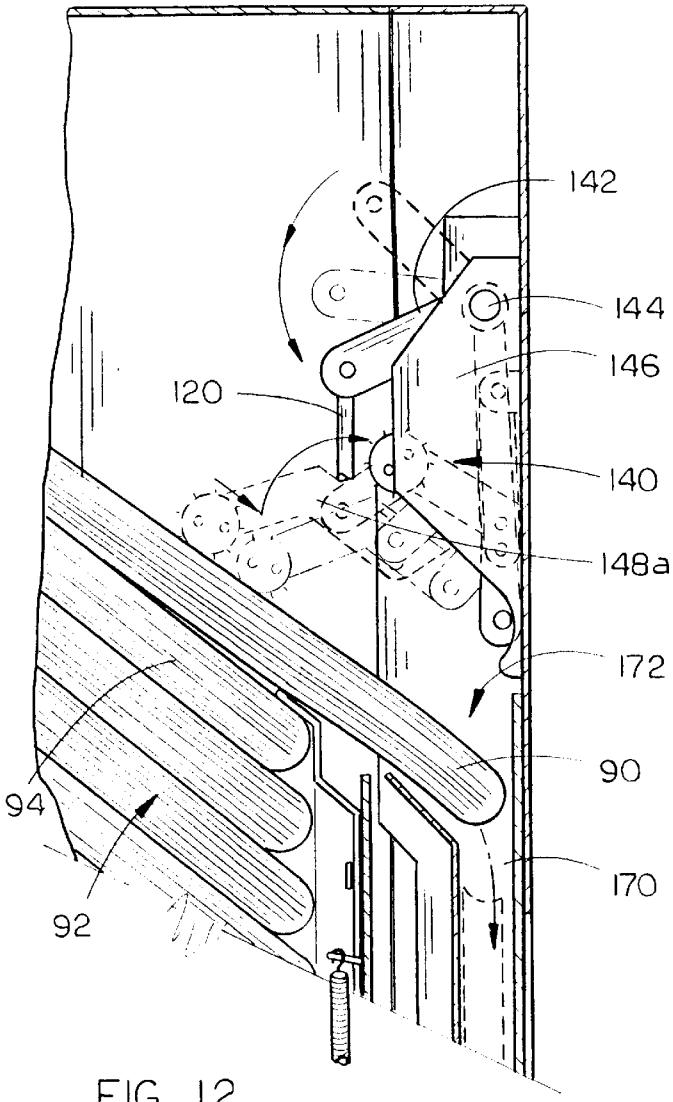
Figure 14:
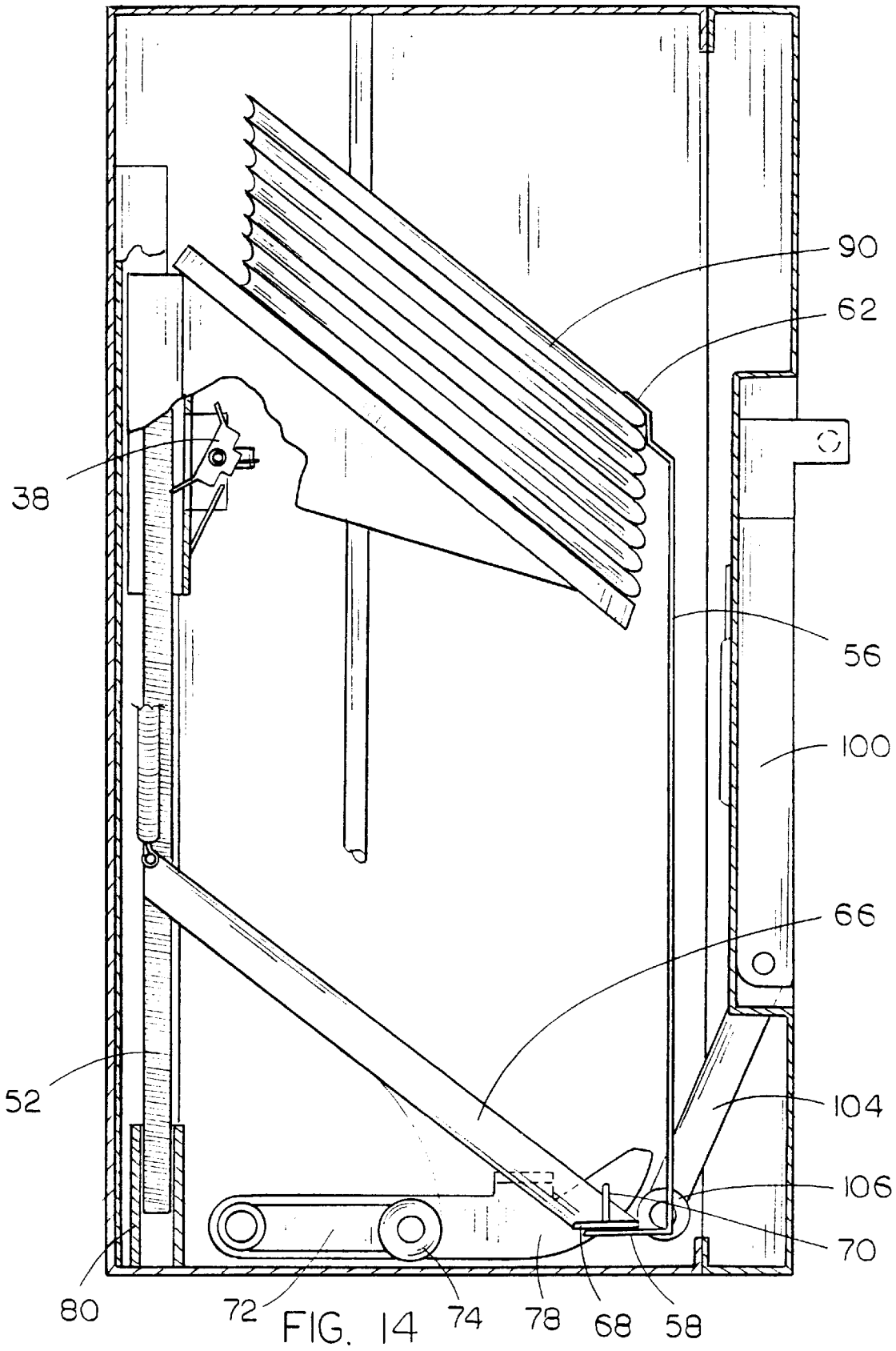
FIGS. 14–16 are side elevational cutaway views of the present invention showing the operation of the elevator system and lifting mechanism which move the stack of newspapers upwards the height of the last newspaper to be dispensed.

The operational characteristics of the front door mechanisms can best be described in terms of sequential operations taking place as the operating handle 100 is rotated through the full extent of its rotation. First, as the operating handle 100 begins to rotate, the metal actuating plate 108 likewise is rotated, thus causing pusher mechanism actuation bar 120 to move upwards. Pusher mechanism actuation bar 120 is connected at the upper end thereof to an arm 142 which extends outward from and is fixedly connected to a pivot rod 144 which extends generally horizontally through left chute wall 126 and extends across the pusher mechanism 144 as shown in FIG. 4. Pusher mechanism 140 is preferably held within a generally U-shaped pusher mechanism housing 146 which houses a pair of pusher arms 148*a* and 148*b* which are operatively connected to pusher rod 144 such that rotation of pusher rod 144 results in extension of pusher arms 148*a* and 148*b*. FIGS. 10, 11 and 12 disclose one variation of the operative connection between pusher rod 144 and pusher arms 148*a* and 148*b*, although it is to be understood that numerous modifications to the pusher mechanism 140 may be incorporated in the present invention so long as the basic functionality of the pusher mechanism 140 is not impaired.

It is preferred that the engagement mechanisms for pusher arms 148*a* and 148*b* be substantially similar and, therefore, the following description of the connection of pusher arm 148*a* to pusher rod 144 should be understood to apply to the connection of pusher arm 148*b* to pusher rod 144. Pusher arm 148*a* preferably includes an angle of approximately 45 degrees and is divided into a connection leg 150 and an engagement leg 152 which has at the end thereof a needle-equipped engagement wheel 160. The end of connection leg 150 is connected directly to pusher rod 144 by a connection strut 154 with the connection of connection strut 154 to connection leg 150 being a pivotable connection. Rotation of pusher rod 144 thus results in pusher arm 148 being pivoted away from the outer wall 132 of front door 14. To direct the movement of pusher arm 148*a* as desired to engage the topmost paper 90 on the stack 92, a guide link 156 extends between a pivotable connection mounted on the outer wall 132 of front door 14 and is connected to connection leg 150 of pusher arm 148 forward of the connection of connection strut 154 to connection leg 150. Guide link 156 preferably also includes a pivot joint 158 which divides the guide link 156 into a long and a short section. Guide link 156 directs the movement of pusher arm 148*a* so that engagement leg 152 is moved forwards and downwards to engage the topmost paper 90 on the stack 92.

The pusher mechanism 140 thus operates in the following manner. As actuation bar 120 is moved upwards, lever arm 142 is likewise moved upwards rotating pusher rod 144 in a clockwise manner. The rotation of pusher rod 144 moves connection strut 154 outward from outer wall 132 of front door 14 thus pivoting the pusher arms 148*a* and 148*b* from a rest position as shown in FIG. 10 to an engagement position as shown in FIG. 11. As rotation of lever arm 142 continues, connection strut 154 is further rotated and guide link 156 causes the engagement leg 152 and engagement wheel 160, and the needles thereon, to remain in contact with the topmost paper 90 thus forcing the topmost paper 90 rearward and upwards on the stack 92. The topmost paper 90 is thus removed from underneath the newspaper thickness sensing bar 56 and specifically paper-engaging tab 62, allowing the newspaper thickness sensing bar 56 to fall downwards to contact the next highest paper 94 on stack 92. When operating handle 100 is returned to its rest position, the pusher rod 144 is rotated counter-clockwise, thus reversing the motion of pusher arms 148*a* and 148*b* and allowing the topmost paper 90 to move downwards and forwards over the paper-engaging tab 62 of newspaper thickness sensing bar 56. As the pusher arms 148*a* and 148*b* return to their rest position, they disengage from the topmost paper 90 and gravity takes over as the topmost paper 90 slides forwards and downwards into the opening 172 of paper release chute 170. Because the elevator system has already moved the next highest paper 94 on the stack 92 to the position of the previous topmost paper 90, the entire process is ready to begin again.

As operating handle 100 is rotated, the display paper 180, shown best in FIGS. 2 and 3 is dispensed as the actuating plate 108 causes the gate mechanism 124 at the bottom of chute 170 to open. Gate mechanism 124, shown best in FIGS. 18 and 19, includes a gate bar 163 which is connected at one end to the gate 164 itself and at the other end to a pin 162 which extends transversely through right leg 116 of slot 112. Gate 164 is pivotably mounted adjacent chute 170 and closes off chute 170 when the handle 100 is in rest position. As the handle 100 is rotated, the pin 162 within slot 112 slides and causes rotation of the gate 164 to an open position, as shown in FIG. 18. In FIG. 19, it is shown that if the display paper 180 is not removed, the gate 164 cannot close, and thus the movement of handle 100 back to rest position is prevented.

Figure 15:
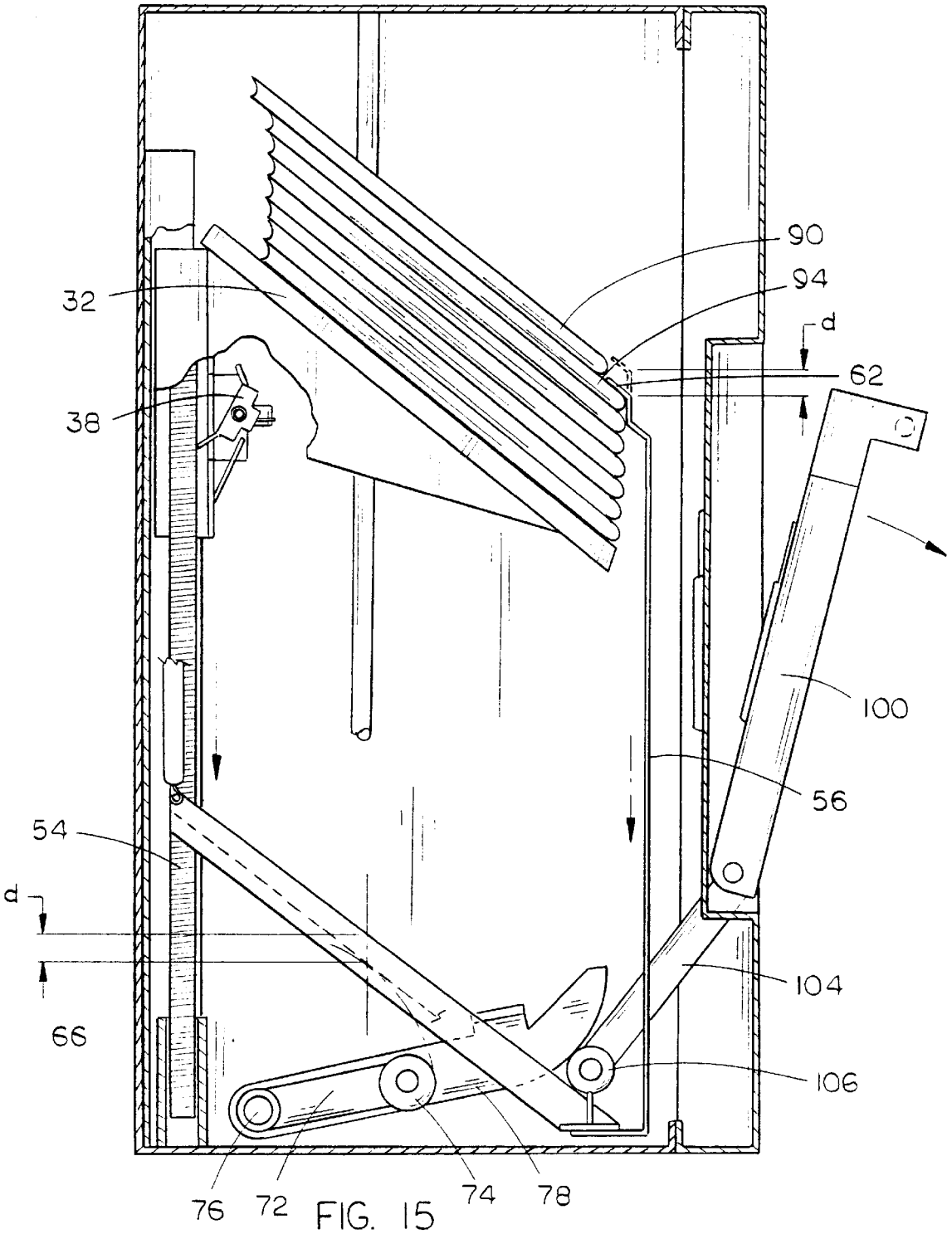
Figure 16:
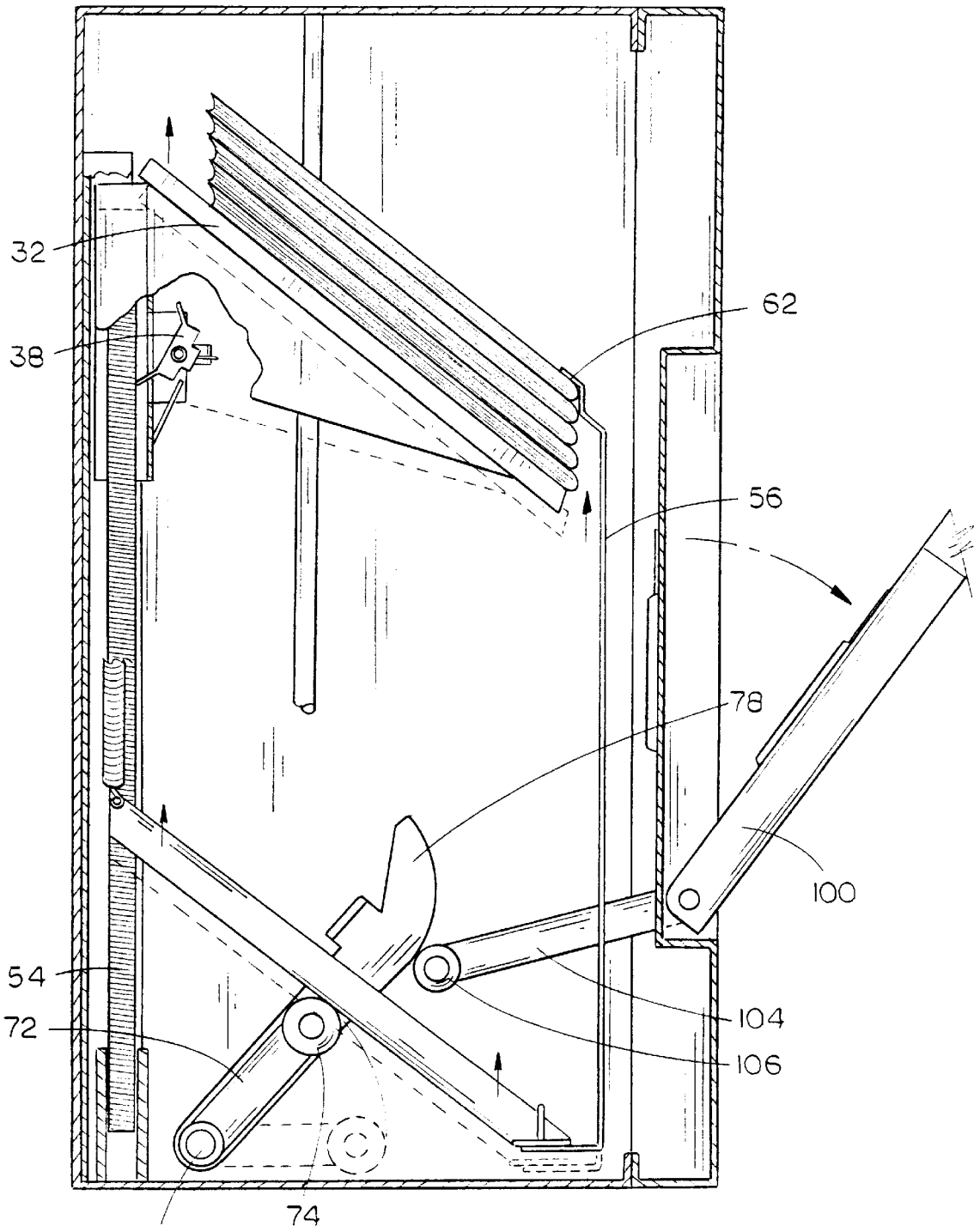

The lever-engaging bar 104 and roller 106 thereon engages the lever 78 after the above operations have occurred during the rotation of handle 100. The lever-engaging bar 104 pushes the lever 78 upwards thus pivoting lift rod 76, lift bar 72 and roller 74, as shown best in FIGS. 14–16. In FIG. 15, the above-described operations (the operation of the pusher mechanism and the opening of the gate) have occurred or are occurring. It is seen that the lift bar 72 has yet to contact the diagonal strut 66 in FIG. 15, but that in FIG. 16 the upwards shift of diagonal strut 66 and therefore vertically movable ridged rack 52 and newspaper support trolley 24 due to the connection of second pawl 38 with rack 52 is performed by contact of lift bar 72 with diagonal strut 66. As was described previously, the distance "d" of the upwards shift of newspaper support trolley 24 is exactly equal to the thickness of the topmost newspaper 90 given by the distance fallen by the newspaper thickness sensing bar 56. The engagement of first rack-engaging pawl 36 with fixed ridged rack 50 keeps the newspaper support trolley 24 at the same height until the trolley is moved upwards as described above.

It should be noted that once the refilling of newspapers has been completed, the refiller should manually lift lever 78 to set the newspaper support trolley to the correct height. The door 14 is then closed and locked and the handle 100 is operated to dispense the first paper into the display window 182, as shown in FIG. 1, thus "priming" the newspaper vending machine 10.

FIGS. 18–21 show the handle return prevention device 122, which includes a shift bar 135 pivotably connected to a ratchet bar 136 at one end thereof and including a transversely extended pin 134 which extends into slot 112. Pivotably mounted on the opposite end of ratchet bar 136 is a ratchet 137 which ratchetly engages a ratchet plate 138 mounted on and extending inwards from door 14. If the handle 100 is not opened to its full extent and the operator attempts to return the handle 100 to its rest position, the ratchet 137 catches on ratchet plate 138 thus causing ratchet bar 136 to be retained in seat 139 in plate 108 until the operator finishes opening the handle 100 to its full extent. This will prevent operation of the newspaper vending machine 10 in an improper manner.

Figure 22:
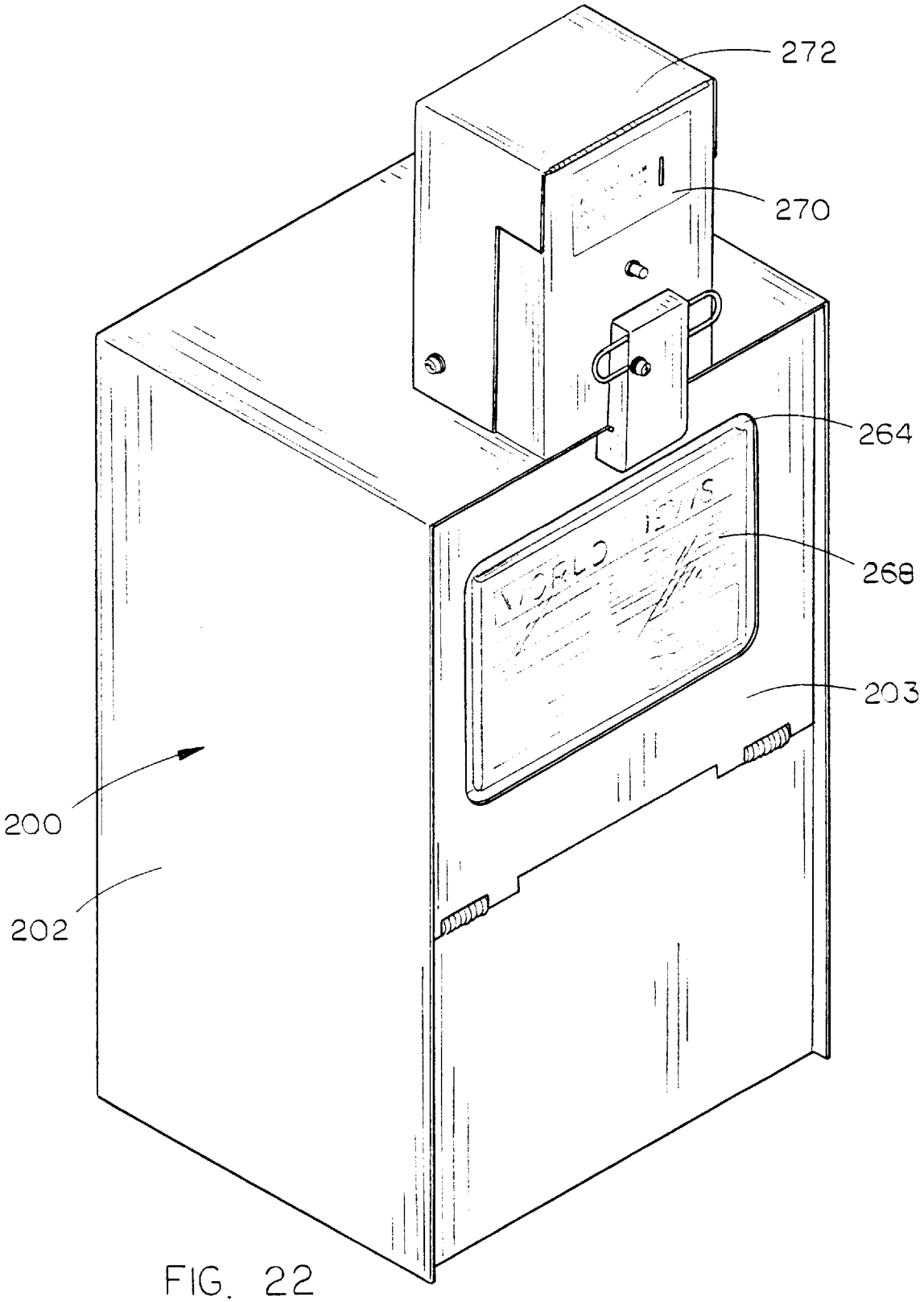
FIG. 22 is a perspective view of a second embodiment of the single vend newspaper vending machine of the present invention.
Figure 24:
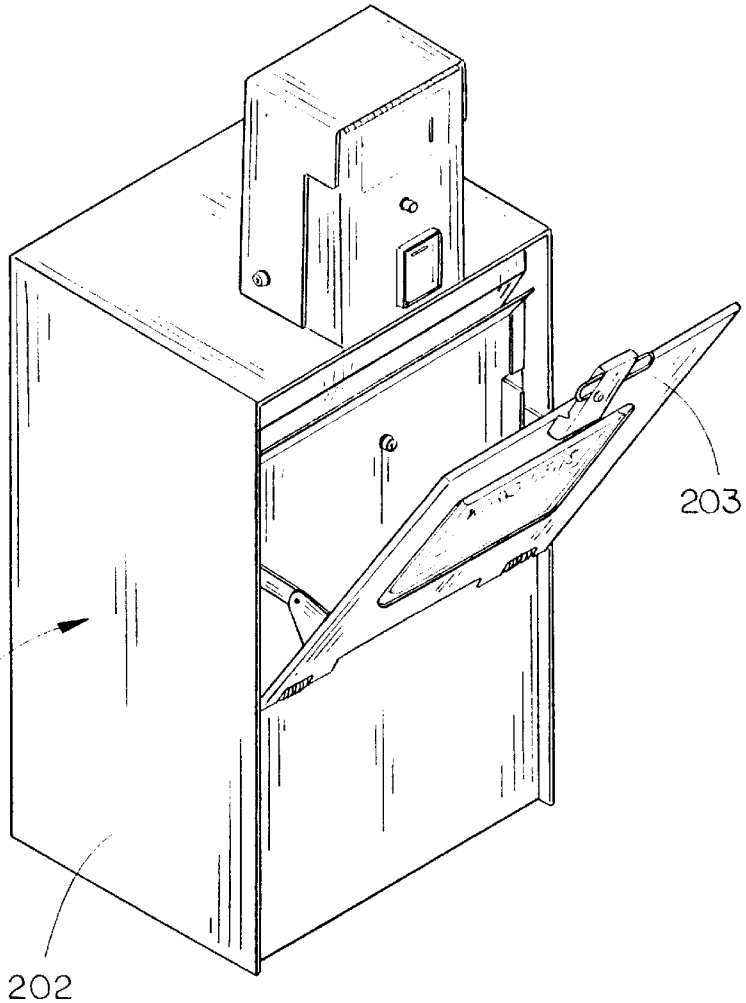
FIGS. 23 and 24 are perspective views of the embodiment of FIG. 22 showing the dispensing of a paper therefrom.
Figure 23:
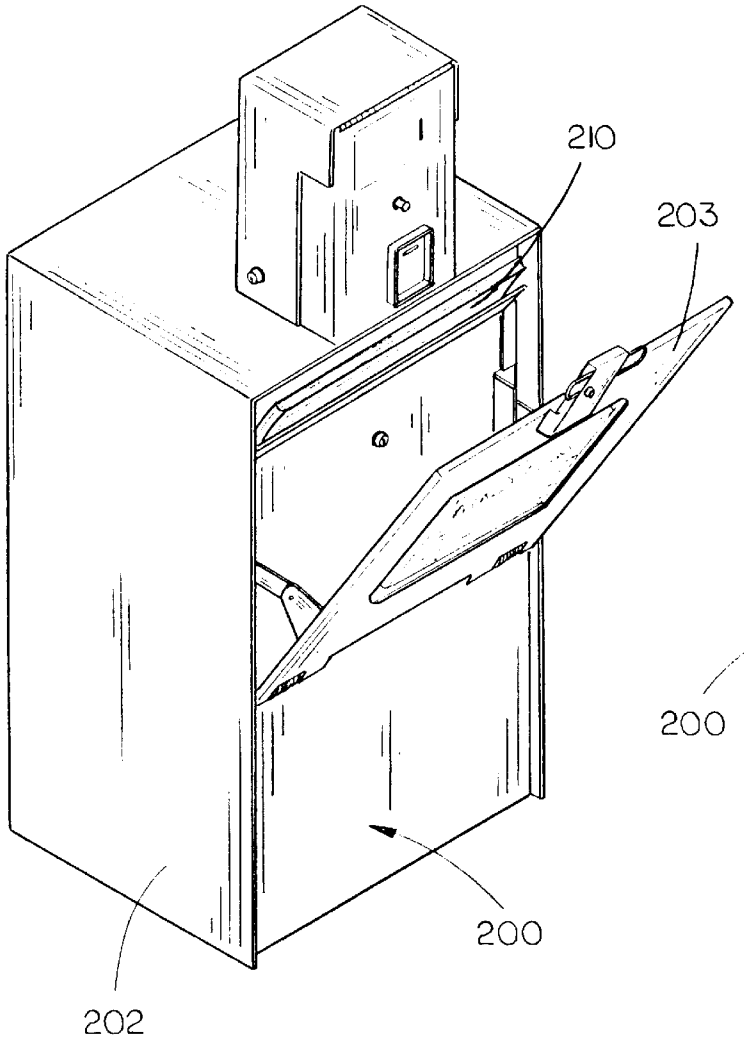
Figure 28:
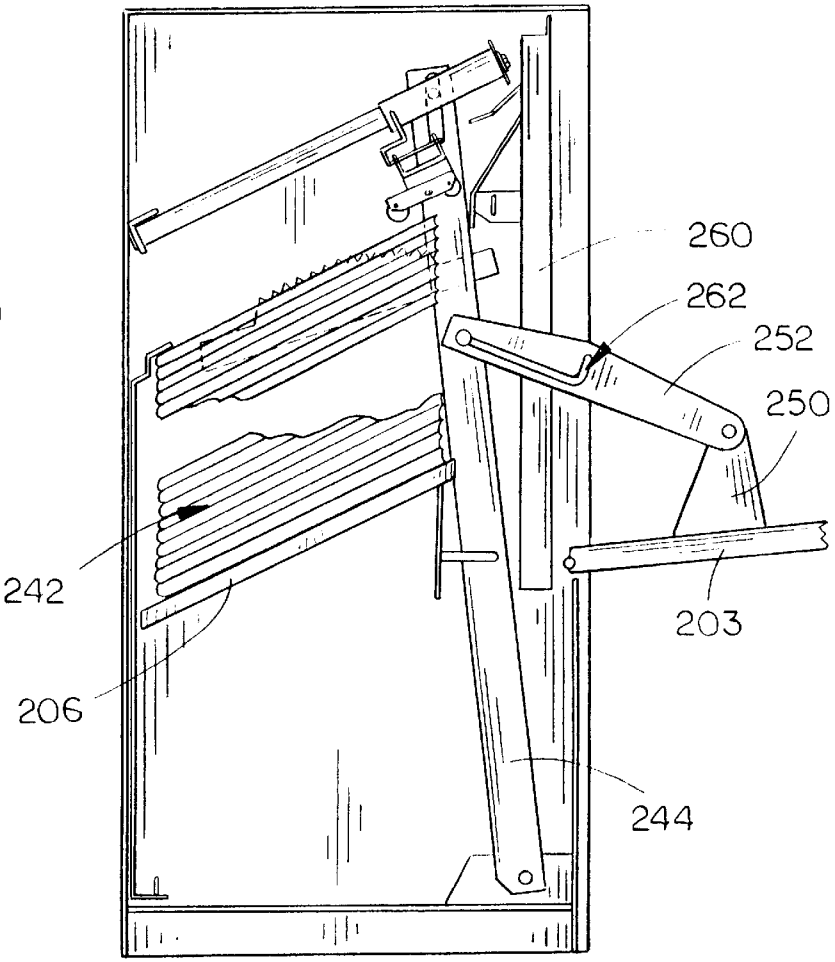
Figure 29:
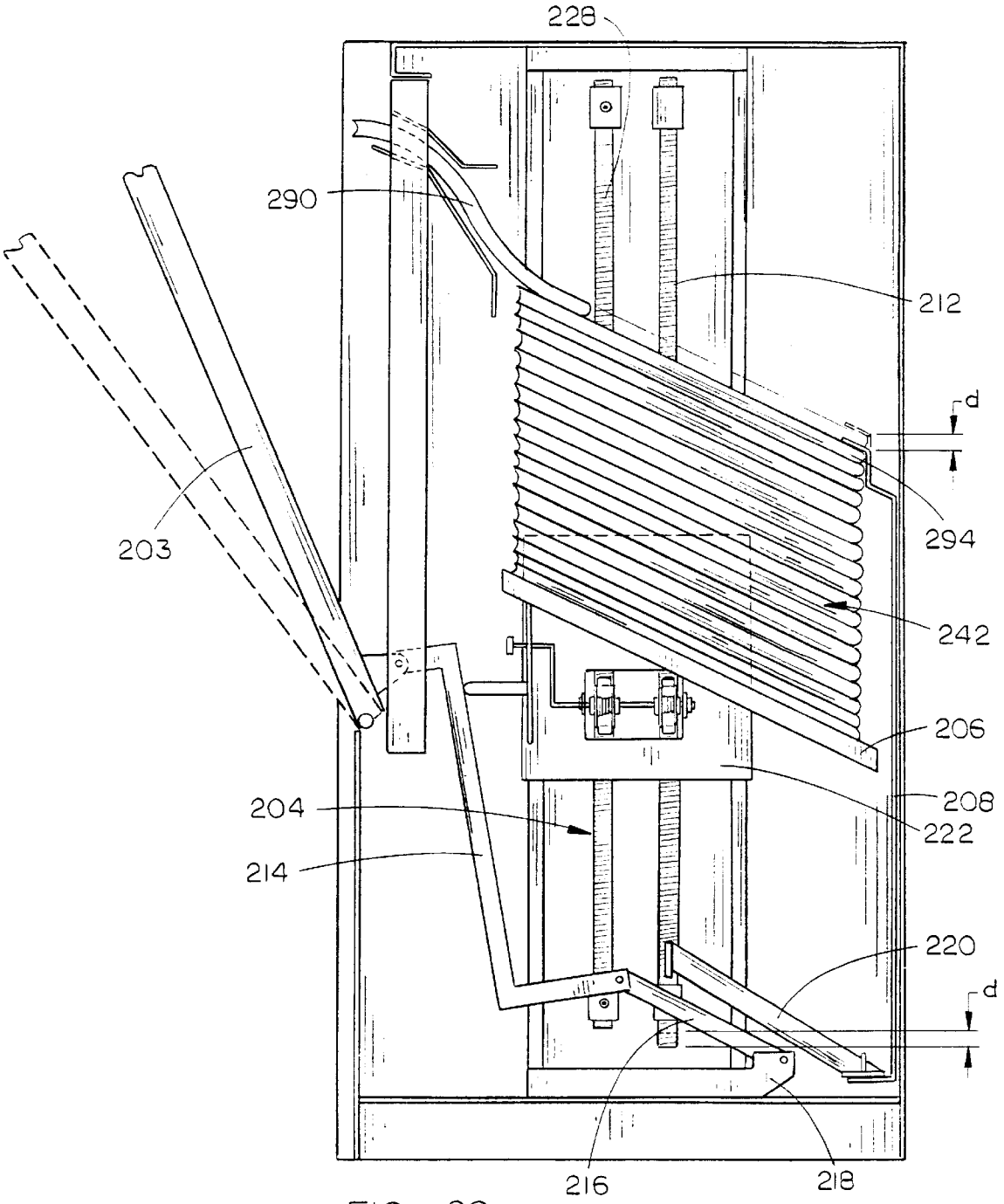
FIGS. 29 and 30 are partial side elevational views of the embodiment of FIG. 22 showing the operation of the elevator system therein.
Figure 30:
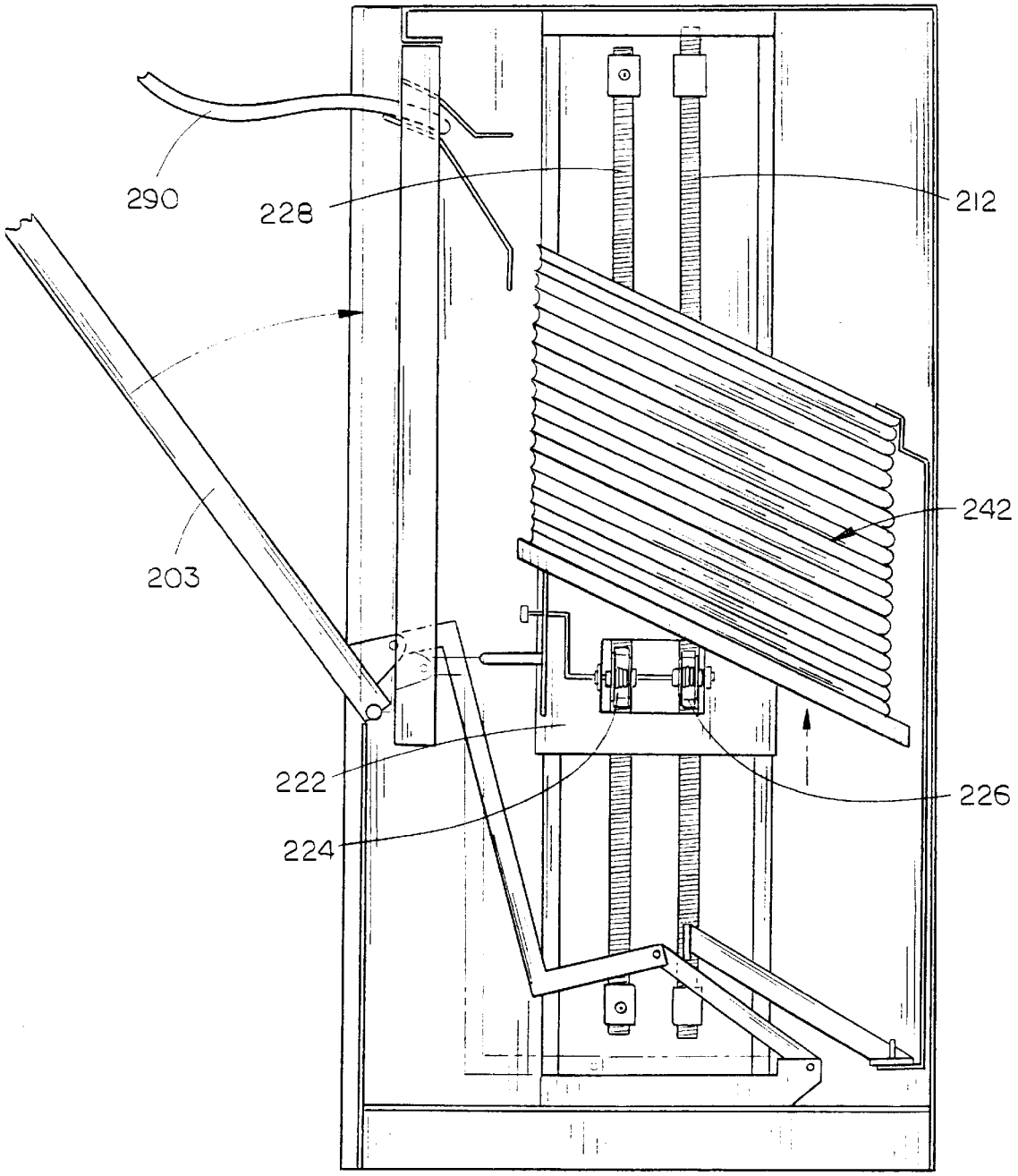
Figure 31:
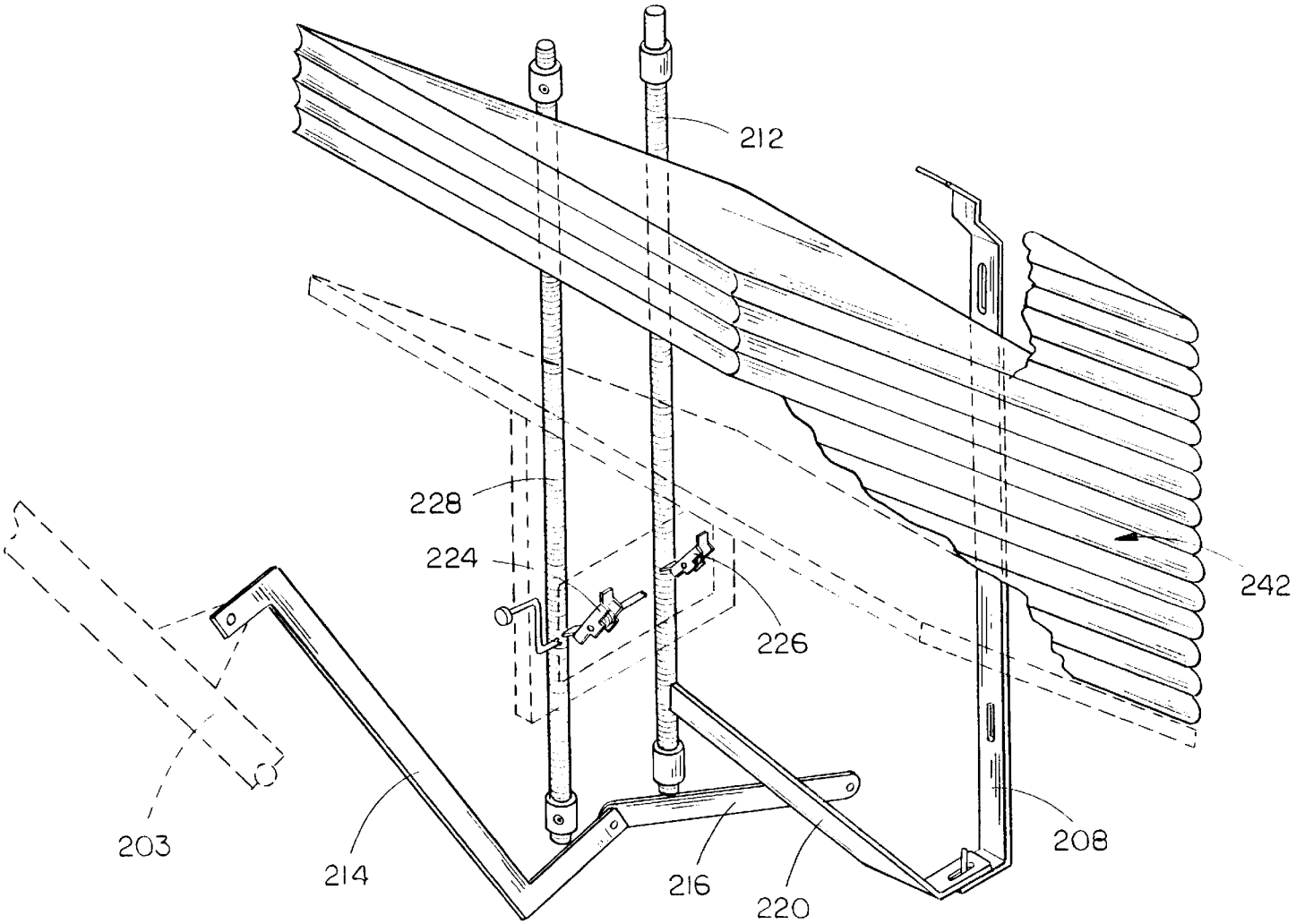
FIG. 31 is a partial detail perspective view of the embodiment of FIG. 22 again showing the elements of the elevator system.

An alternative embodiment of the invention is shown in FIGS. 22–31 and is designed to be used in a stand-alone street side vending location. As shown in FIG. 22, the machine housing 202 of the alternative embodiment of the single vend newspaper vending machine 200 has generally the same shape and dimension as a standard newspaper dispenser found on streets around the world. FIGS. 23 and 24, however, show a newspaper being dispensed by the embodiment as shown in FIGS. 22–31, showing that the paper is slid out of the machine through a slot and extends out of the slot approximately 3–5 inches to allow a person to grasp a paper and remove it from the slot of the machine 200. Alternative embodiment 200 preferably includes an elevator system 204 (as shown in FIGS. 25–31) substantially similar to that described in connection with single vend newspaper vending machine 10 with the only minor differences being the fact that the newspaper support platform 206 is tilted rearwardly such that a stack of newspapers is tilted as shown in FIGS. 29 and 30 and the newspaper thickness device 208 detects the thickness of the topmost paper to be dispensed at the back of the machine instead of the front. Also, the lifting mechanism for the vertically moveable rack 212 consist of a series of linkages 214 and 216 connected to an upwardly tilting bar 218 which engages diagonal strut 220 lifting rack 212 in the same manner as was described previously in connection with the first embodiment. In virtually all other respects, the newspaper support trolley 22, the first and second rack-engaging pawls 224 and 226 and fixed ridged rack 228, operate in substantially the same manner as was described previously in connection with the embodiment in the first section of this document.

Figure 26:
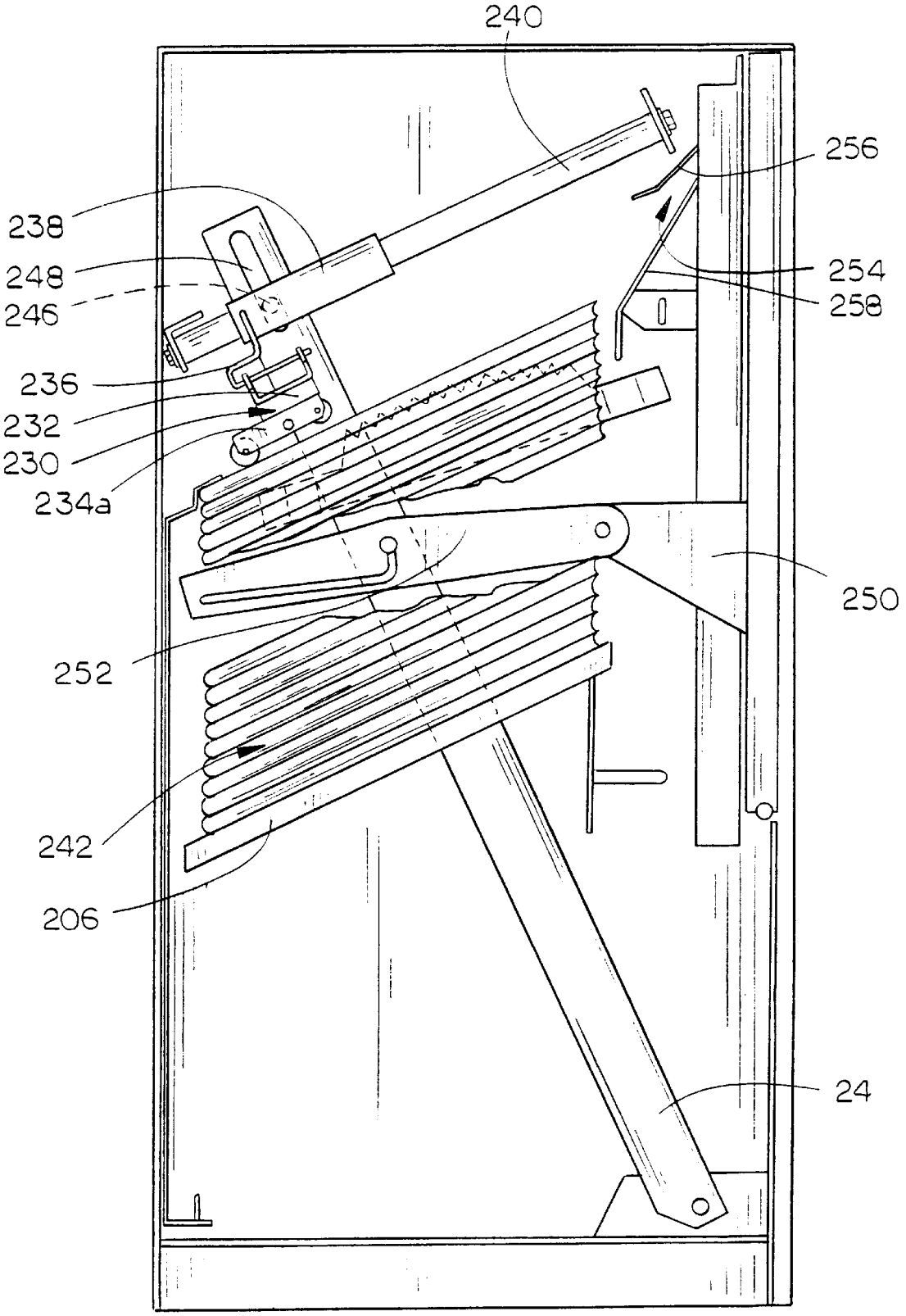
FIG. 26, 27 and 28 are partial side elevational views of the embodiment shown in FIG. 22 demonstrating the dispensing process for a newspaper and how the door may be opened further to permit easy reloading of newspapers.
Figure 27:
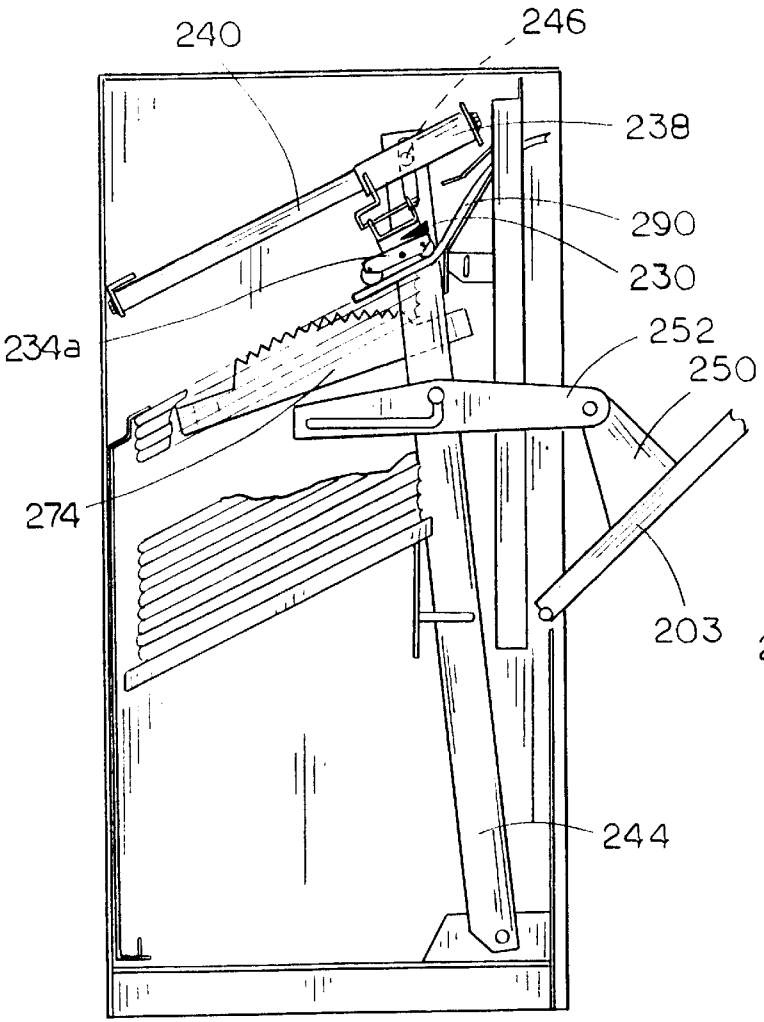

The main difference between the first embodiment 10 and the second embodiment 200 is that the distance which the pusher mechanism 230 must move the topmost paper 290 in order to properly dispense the paper 290 is much greater in the second embodiment 200 than in the first embodiment. FIGS. 26 and 27 best show the pusher mechanism 230 of the present invention in operation and the elements thereof.

Figure 25:
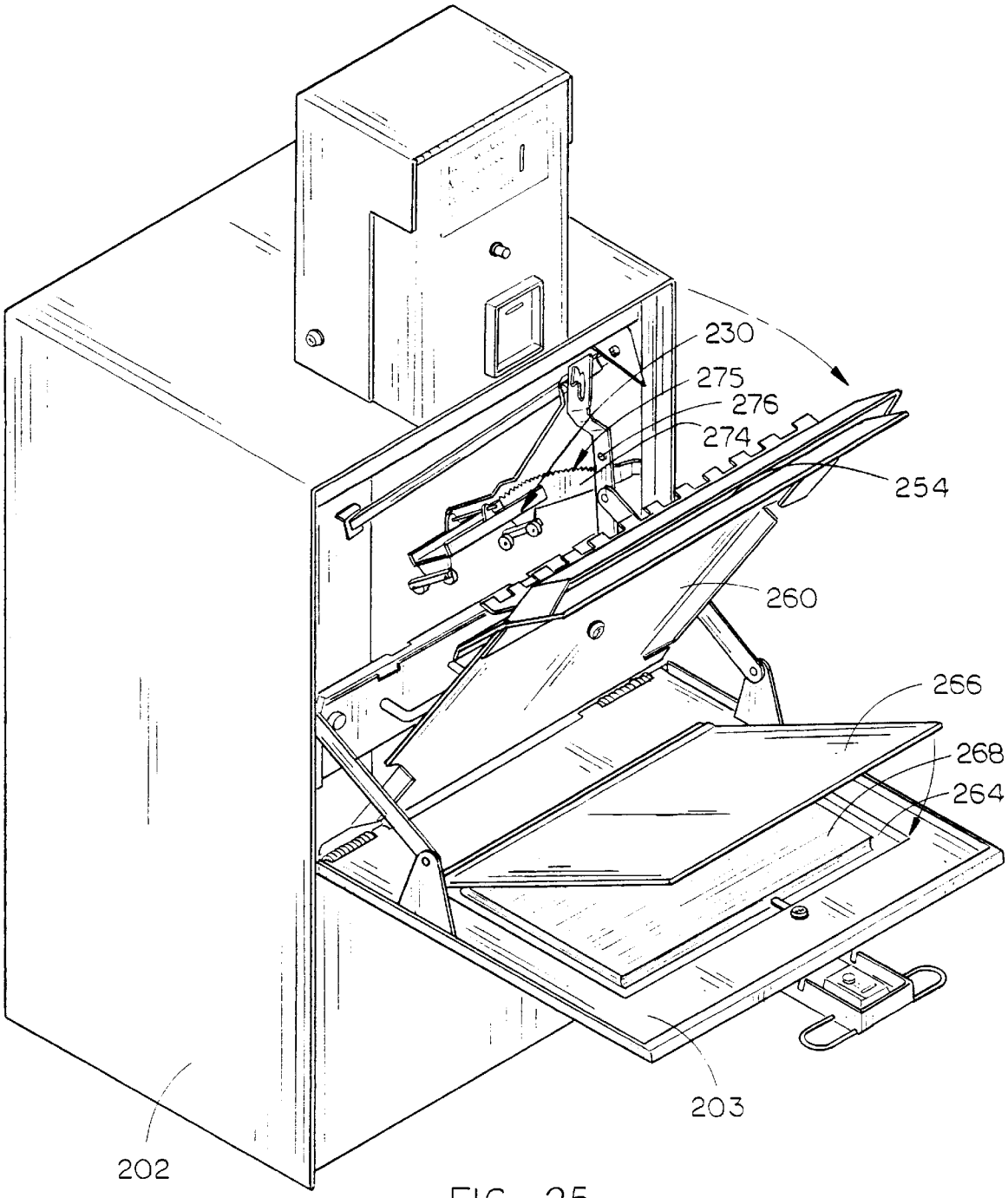
FIG. 25 is a perspective view of the embodiment of FIG. 22 showing the internal mechanism of the second embodiment.

As shown in FIG. 25, pusher mechanism 230 of the second embodiment 200 is preferably designed as a carriage having a transversely extended body 232 preferably formed of a piece of C-channel, the pusher mechanism 230 further including two depending wheel sets 234*a* and 234*b*, the rearmost wheels of each wheel set 234*a* and 234*b* being a rotatably mounted standard-type wheel and the forward wheel of each wheel set 234*a* and 234*b* including downwardly depending needles which engage the upper surface of the topmost paper 290 and drag the topmost paper 290 forward for dispensing thereof. Connected to and extending from the top of the C-channel body 232 is a pusher mechanism support bar 236 which is angled to extend from and connect to a guide sleeve 238 which is slidably mounted on an guide bar 240 mounted angled upwards, shown best in FIGS. 26–28. It is preferred that guide bar 240 be mounted to the side of machine housing 202 at an angle approximately equal to the angle of the newspaper support platform 206 so that as guide sleeve 238 travels along guide bar 240, the pusher mechanism 230 remains in contact with the topmost paper 290 of the newspaper stack 242 supported on the newspaper support platform 206.

It should be noted that pusher mechanism 230 is mounted on pusher mechanism support bar 236 such that the C-channel body 232 may pivot about the support bar 236 at the connection point thereof. This is to ensure that wheel sets 234*a* and 234*b* will be in contact with the topmost paper 290 at all times. Furthermore, the connection of support bar 236 to guide sleeve 238 is also preferably pivotable so that when guide sleeve 238 is slid along guide bar 240, the forward wheels of wheel sets 234*a* and 234*b* are brought into contact with the topmost paper 290 thereby engaging the topmost paper 290 with the needles on the forward wheels and thereby pushing the topmost paper 290 forward due to that contact.

The movement of the guide sleeve 238 along guide bar 240 is performed in the following manner and by the following mechanism. A pivoting drive bar 244 preferably extends upward and is pivotably mounted adjacent the base the machine housing 202 and is connected to guide sleeve 238 by a pin 246 extending through a generally longitudinal slot 248 formed in drive bar 244, as shown best in FIGS. 26–28. A strut 250 is mounted on the front door 203 of the machine housing 202 and extends inwardly therefrom to be pivotably connected to an arm 252 which extends between the strut 250 and the drive bar 244, the connection of the arm 252 to drive bar 244 being intermediate the connection the drive bar 244 adjacent the floor of machine housing 202 and the connection of drive bar 244 to the guide sleeve 238. In this manner, as housing door 203 is tilted outward and forwards, drive bar 244 is likewise pivoted forwards about the pivotable connection of drive bar 244 adjacent the floor of machine housing 202 due to the direct linkage of the strut 250 to drive bar 244. This pivotable motion of drive bar 244 moves the guide sleeve 238 forwards and upwards along guide bar 240 thereby moving pusher mechanism 230 forwards and upwards along therewith. At the beginning of movement of guide sleeve 238, the forward wheels of wheel set 234*a* and 234*b* are tilted slightly downwards to engage the topmost paper 290 with the needles on the forward wheels of wheel sets 234*a* and 234*b*. Topmost paper 290 is thus pushed forwardly and upwardly off of the top of the stack 242 thus permitting the newspaper thickness sensing device 208 to drop to the next highest paper 294. As the forward motion of pusher mechanism 230 continues, the topmost paper 290 is directed into a dispensing slot 254 which dispenses through front access guard panel 260 as shown in FIG. 23. Dispensing slot 254 preferably includes upper and lower slot guides 256 and 258 which act to direct the topmost paper 290 into dispensing slot 254 for easier dispensing thereof. When the front door 203 of sheet housing 202 is tilted as far outwardly as possible, as shown in FIG. 23 and 24, the topmost paper 290 may be removed from dispensing slot 254 and the front door 203 can be released to return to the closed position. As the door is being closed, the pusher mechanism 230 is tilted back slightly such that only the rearmost wheels of the wheel sets 234*a* and 234*b* engage the new topmost paper 294 on the stack 242. As the rearmost wheels do not include needles or the like, movement of the pusher mechanism 230 over the topmost paper in a rearward direction is permitted without damaging the paper.

Refilling of the second embodiment 200 may be quickly and easily achieved by opening of the front access guard panel 260 after the front door 203 is opened to its full extent. In fact, several different mechanisms are available to allow the front door 203 to open to a greater extent for refilling thereof, including the slot and pin connection 262 displayed on arm 252 as shown in FIG. 28. Once the front access guard panel 260 is opened, the refilling operation takes place in substantially the same manner as was described in connection with the first embodiment, except that the newspapers are preferably placed in the machine housing 202 on newspaper support platform 206 with the open ends of the newspapers facing forwards such that the paper is dispensed through the dispensing slot 254 with the open end of the paper coming through first. One other major difference between the refilling operation of the second embodiment 200 and the first embodiment is that the first paper should not be dispensed to "prime" the newspaper vending machine. Instead, one of the newspapers is separated from the stack 242 and placed within the display window 264 to allow the paper to be shown to the purchasing public. A display window rear door 266 closes behind the display paper 268 and secures the display paper 268 within the display window 264.

Of course, much of the remainder of the machine housing 202 is substantially the same as those stand-along newspaper vending machines found in the prior art. For example, any commercially available coin input mechanism 270 may be used on the head 272 of the machine, the coin input mechanism 270 controlling access to the interior of the machine housing 202 by alternatively locking and unlocking the door 203 in a manner which would perfectly clear to and be understood by those skilled in the art of newspaper vending.

A final important feature of the second embodiment 200 is that unless the door 203 is open to its fullest extent, as show in FIG. 23, the newspaper dispensing mechanism will not reset. A relative simple toothed gear member 274 is mounted to the side of the machine housing 202 adjacent drive bar 244. As the drive bar 244 is moved forward by the tilting of the door 203, a ratchet 276 pivotably mounted on the drive 244 engages the tooth section 275 of gear member 274 such that forward motion of drive bar 244 is permitted but rearward motion of drive bar 244 is not permitted until ratchet 276 reaches the end of tooth section 275 and is allowed to pivot freely such that the rearward motion of drive bar 244 is then permitted. In this manner, the accidental dispensing of multiple newspapers is prevented as the dispensing mechanism cannot be operated until the machine is completely opened and closed.

Figure 32:
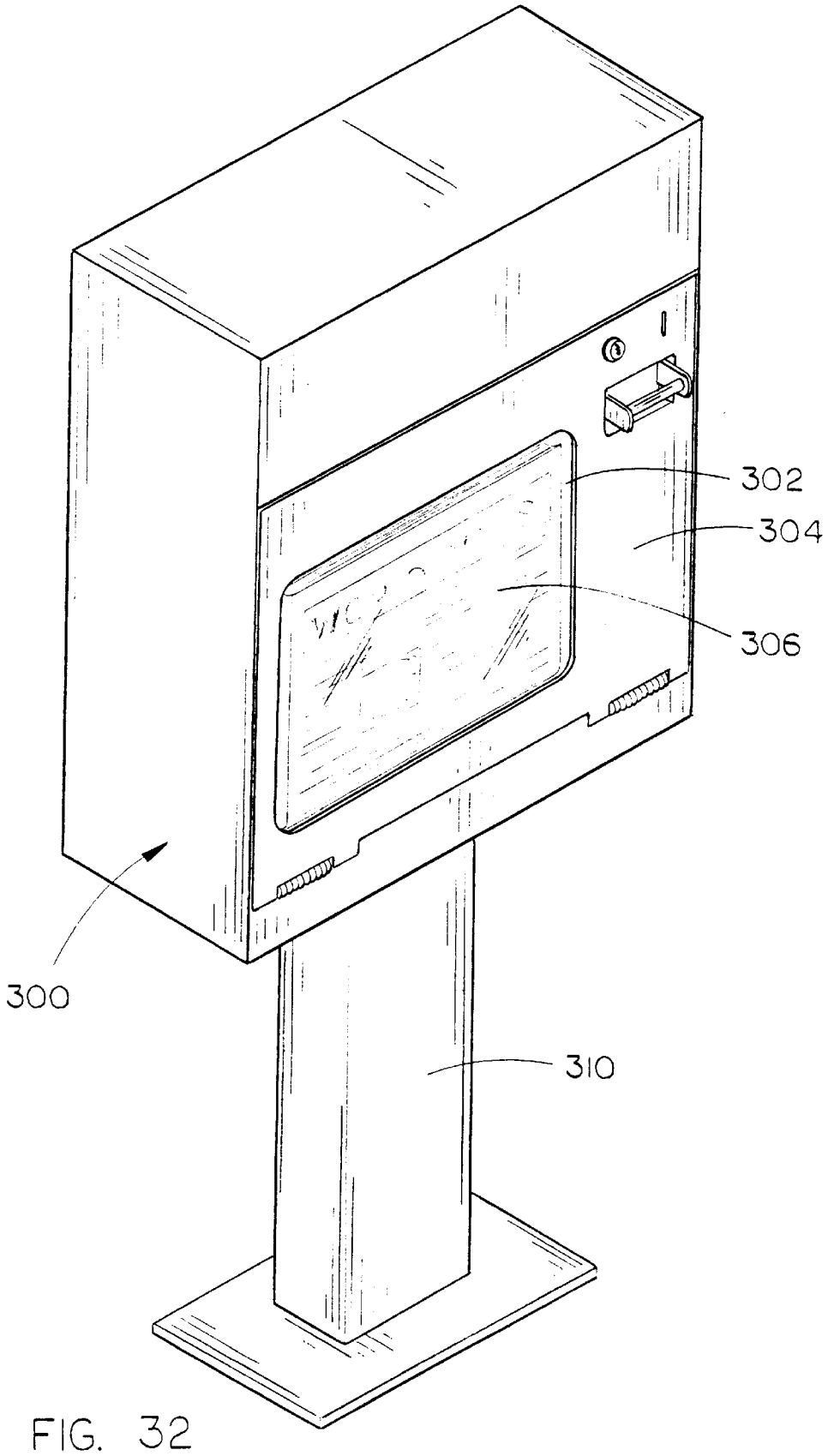
FIG. 32 is a perspective view of a third embodiment of the newspaper vending machine of the present invention.
Figure 33:
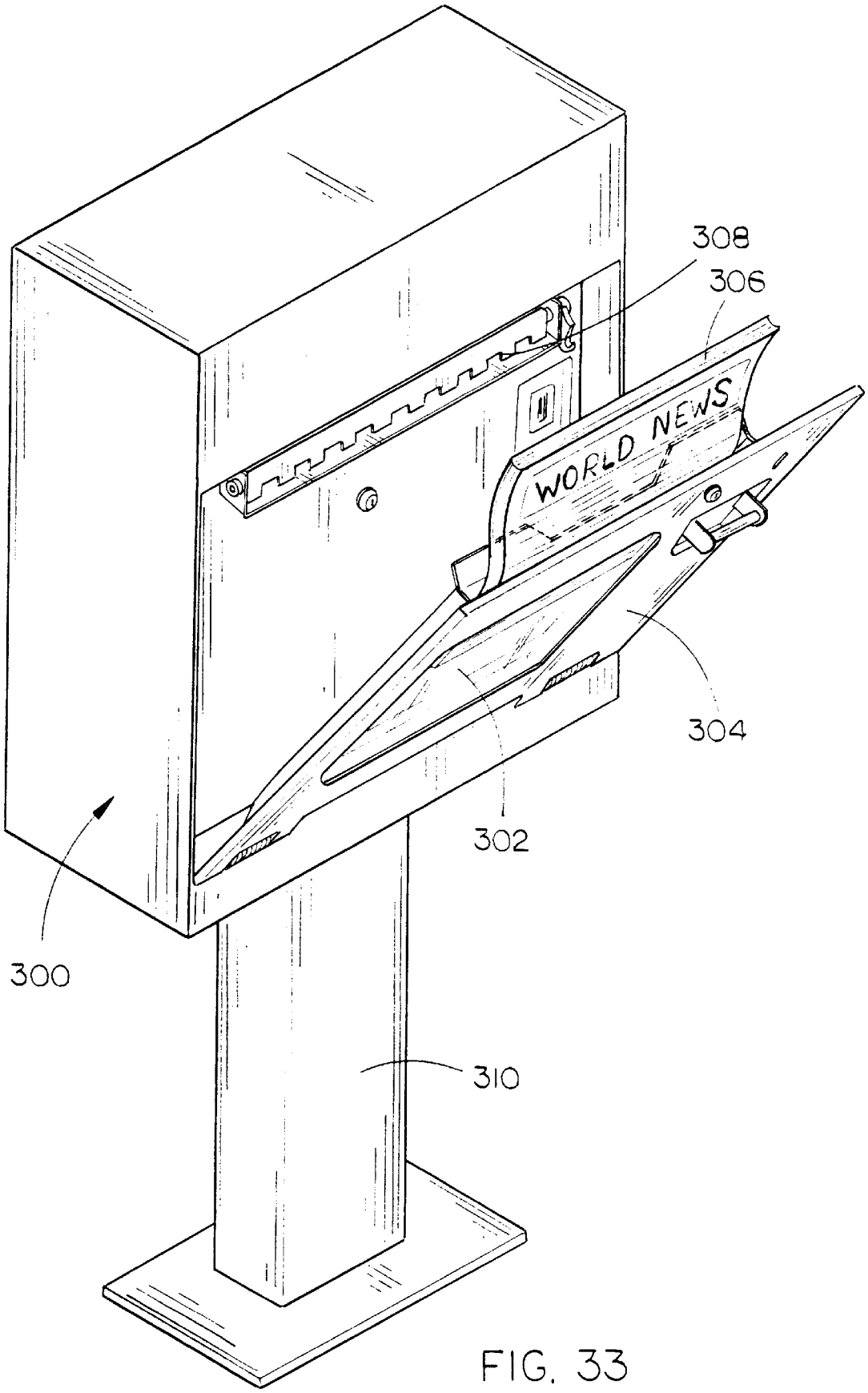
FIG. 33 is a perspective view of the embodiment of FIG. 32 showing a newspaper being dispensed therefrom.

FIGS. 32 and 33 disclose a third embodiment 300 of the present invention which in almost all respects operates exactly the same as the first embodiment herein. However, it is seen that the third embodiment 300 is designed as a stand-alone unit having a pedestal 310 or the like and it is expected that if a dispensing chute such as that described in connection the first embodiment or to be used, an individual would have to stoop to obtain a newspaper which is undesirable. Therefore, the variation envisioned by the inventor is that as the topmost paper is removed from the stack of newspapers, it will fall into a display chute 302 which can be easily accessed by opening the front door 304 of the third embodiment 300 and then reaching into the display chute 302 to remove the newspaper 306 on display therein. When the front door 304 is returned to the close position, the gate 308, shown in FIG. 33, is opened to release the next newspaper on the stack into the display chute 302 and the process begins again. It is expected that the internal functional characteristics of the third embodiment 300 will be substantially identical to those described in connection with the first embodiment.

It is to be understood that numerous modifications, substitutions and additions may be made to the newspaper vending machines described herein. For example, the exact dimensions, materials and functional characteristics of the features described above may be changed or modified yet still fall within the intended broad scope of the appended claims. Furthermore, it is clear that small variations in the elevator system may be incorporated, such as substituting grip mechanisms and smooth rods for the ridged racks and pawls presently disclosed in the invention. Such a substitution would clearly fall within the intended broad scope of the appended claims. Additionally, the precise arrangement of the features within the newspaper vending machines described herein may be changed or modified so long as the functionality of the invention is not impaired. Finally, modification of the size, shape and appearance of the three embodiments described herein is expected and will not affect the disclose contained herein.

There have therefore been shown and described single vend newspaper vending machines which accomplish at least all of the stated objectives.

We claim:

1. A single vend newspaper vending machine comprising;

a machine housing having outer walls;

a newspaper elevator system mounted in said machine housing, said newspaper elevator system including;

track means mounted in said machine housing;

a fixed position height control member mounted in said machine housing;

a vertically movable height control member mounted in said machine housing;

a newspaper support trolley movably mounted on said track means;

first and second releasable height control member engagement means, said first engagement means operative to engage said fixed position height control member, said second engagement means operative to engage said vertically movable height control member;

said track means, said fixed position height control member, said vertically movable height control member and said newspaper support trolley mounted within said machine housing such that when said newspaper support trolley is movably mounted on said track means, said first releasable height control member engagement means engages said fixed position height control member and said second releasable height control member engagement means engages said vertically movable height control member;

said first releasable height control member engagement means operative to restrict downward movement of said newspaper support trolley when engaging said fixed position height control member, said second releasable height control member engagement means operative to permit downward movement of said vertically movable height control member, upwards movement of said vertically movable height control member causing said newspaper support trolley to be moved upwardly therewith;

newspaper thickness sensing means movably mounted in said machine housing and operative to determine the thickness of the topmost paper;

newspaper pusher means mounted in said machine housing operative to engage a topmost paper on a newspaper stack supported on said newspaper support trolley and slide the topmost newspaper off of the newspaper stack, said newspaper pusher means moving the topmost newspaper to a dispensing position in which at least part of the topmost newspaper is external of said machine housing whereby a customer can access the topmost newspaper and obtain possession thereof; and newspaper pusher and movable height control member actuation means operatively connected to said newspaper pusher means and said movable height control member such that engagement of said actuation means first actuates said newspaper pusher means to remove the topmost paper from the newspaper stack, said actuation means operative to secondly raise said movable height control member a distance determined by the thickness of the topmost paper as determined by said newspaper thickness sensing means, thereby raising said newspaper support trolley such that the penultimate newspaper replaces the vended topmost newspaper in substantially the same position that the topmost newspaper was in prior to being vended.

2. The single vend newspaper vending machine of claim 1 wherein said fixed position height control member and said vertically movable height control member each comprise ridged racks having a plurality of spaced transverse ridges formed thereon.

3. The single vend newspaper vending machine of claim 2 wherein said first and second releasable height control member engagement means each comprise a rack-engaging pawl pivotably mounted on said newspaper support trolley, said rack-engaging pawls operative to engage said ridges on said racks in a ratchet-type manner to permit one-way motion of said newspaper support trolley while said pawls engage said racks.

4. The single vend newspaper vending machine of claim 1 wherein said newspaper support trolley further comprises an inclined newspaper support plate for supporting a stack of newspapers thereon.

5. The single vend newspaper vending machine of claim 4 wherein said newspaper thickness sensing means comprises a generally flat steel bar including an angled paper-engaging tab which preferably extends generally parallel with said newspaper support plate and extends over and above said newspaper support plate such that the topmost newspaper on the stack of newspapers may be engaged by the underside of said paper-engaging tab, said newspaper thickness sensing means operative to determine the thickness of the topmost newspaper by moving downwards to contact the penultimate newspaper on the stack when the topmost newspaper is moved from underneath said paper-engaging tab by said newspaper pusher means, the thickness of the topmost paper equal to the distance moved downwards by said newspaper thickness sensing means.

6. The single vend newspaper vending machine of claim 1 wherein said newspaper pusher means comprises at least one pusher arm movably mounted above and adjacent to the position of the topmost newspaper, said pusher arm having needle engagement means for slightly piercing the upper surface of the topmost paper, said arm operative to move the topmost paper to a dispensing position.

7. The single vend newspaper vending machine of claim 1 wherein said newspaper pusher and movable height control member actuation means comprises a pivotably mounted operating handle mounted on the exterior of said machine housing, said operating handle operatively connected to said newspaper pusher means and said movable height control member such that rotation of said handle first causes said newspaper pusher means to dislodge the topmost paper to be dispensed and second raises said height control member a distance determined by the thickness of the topmost paper as determined by said newspaper thickness sensing means, thereby raising said newspaper support trolley such that the penultimate newspaper replaces the vended topmost newspaper in substantially the same position that the topmost newspaper was in prior to being vended.

8. The single vend newspaper vending machine of claim 1 further comprising a coin input device operative to accept coins and restrict operation of said newspaper pusher and movable height control member actuation means unless the correct coinage is deposited in said coin input device.

9. A single vend newspaper vending machine comprising;

a machine housing having outer walls;

a newspaper elevator system mounted in said machine housing, said newspaper elevator system including;

at least one generally upright track means mounted in said machine housing;

a generally upright, fixed position height control member mounted in said machine housing;

a generally upright, vertically movable height control member mounted in said machine housing;

a newspaper support trolley movably mounted on said track means such that said newspaper support trolley is generally vertically movable along said track means;

first and second releasable height control member engagement means, said first engagement means operative to engage said fixed position height control member, said second engagement means operative to engage said vertically movable height control member;

said track means, said fixed position height control member, said vertically movable height control member and said newspaper support trolley mounted within said machine housing such that when said newspaper support trolley is movably mounted on said track means, said first releasable height control member engagement means engages said fixed position height control member and said second releasable height control member engagement means engages said vertically movable height control member;

said first releasable height control member engagement means operative to permit only upward movement of said newspaper support trolley when engaging said fixed position height control member, said second releasable height control member engagement means operative to permit downward movement of said vertically movable height control member, but upwards movement of said vertically movable height control member causes said newspaper support trolley to be moved upwardly therewith;

newspaper thickness sensing means movably mounted in said machine housing, said newspaper thickness sensing means operatively connected to said movable height control member whereby vertical movement of said newspaper thickness sensing means causes vertical movement of said movable height control member, said newspaper thickness sensing means releasably engaging a topmost newspaper on a newspaper stack supported on said newspaper support trolley;

newspaper pusher means mounted in said machine housing operative to engage a topmost paper on a newspaper stack supported on said newspaper support trolley and slide the topmost newspaper off of the newspaper stack from underneath said newspaper thickness sensing means whereby said newspaper thickness sensing means moves downwards to contact the penultimate newspaper on the newspaper stack, said newspaper pusher means then operative to release said topmost paper to slide downwards off of the stack of newspapers;

newspaper pusher and movable height control member actuation means operatively connected to said newspaper pusher means and said movable height control member such that engagement of said actuation means first actuates said newspaper pusher means to remove the topmost paper from the newspaper stack thereby causing said movable height control member to move downwards a distance equal to the distance moved by said newspaper thickness sensing means, said actuation means operative to secondly raise said movable height control member substantially the same distance said movable height control member moved downwards, thereby raising said newspaper support trolley such that the penultimate newspaper replaces the vended topmost newspaper in substantially the same position that the topmost newspaper was in prior to being vended; and dispensing chute means formed extending through one of said outer walls of said machine housing, said dispensing chute means oriented within said housing such that as the topmost newspaper is released by said newspaper pusher means and slides off of the newspaper stack, the topmost newspaper falls into said dispensing chute means and is transported to the exterior of said machine housing to permit access to the newspaper by a purchaser.

10. The single vend newspaper vending machine of claim 9 further comprising a coin input device operative to accept coins and restrict operation of said newspaper pusher and movable height control member actuation means unless the correct coinage is deposited in said coin input device.

11. A single vend newspaper vending machine comprising;

a machine housing and newspaper support means movably mounted within said machine housing for supporting a stack of newspapers thereon;

adjustable height retention means mounted within said housing for retaining said newspaper support means at a height;

newspaper thickness sensing means mounted within said housing for determining the thickness of a topmost newspaper on the stack;

variable lifting means for said newspaper support means operative to lift said newspaper support means various distances, said lift distance determined by the thickness of the topmost newspaper as determined by said newspaper thickness sensing means, said newspaper support means retained at the new height by said height retention means;

newspaper removal means mounted within said housing operative to engage the topmost newspaper, remove that newspaper from the top of the stack and release the newspaper for dispensing of the newspaper; and newspaper removal and lifting actuation means operative to actuate said newspaper removal means and said lifting means whereby the topmost paper is dispensed and the next paper is moved to a dispensing position.

* * * * *